US008470506B2

(12) United States Patent
Yamamoto

(10) Patent No.: US 8,470,506 B2
(45) Date of Patent: Jun. 25, 2013

(54) TONER, AND IMAGE FORMING METHOD AND APPARATUS USING THE TONER

(75) Inventor: Atsushi Yamamoto, Kawanishi (JP)

(73) Assignee: Ricoh Company, Limited, Tokyo (JP)

( * ) Notice: Subject to any disclaimer, the term of this patent is extended or adjusted under 35 U.S.C. 154(b) by 734 days.

(21) Appl. No.: 12/555,560

(22) Filed: Sep. 8, 2009

(65) Prior Publication Data

US 2010/0068646 A1 Mar. 18, 2010

(30) Foreign Application Priority Data

Sep. 17, 2008 (JP) ..... 2008-238467

(51) Int. Cl.
*G03G 9/087* (2006.01)

(52) U.S. Cl.
USPC ..... 430/109.3; 430/109.1; 430/109.4

(58) Field of Classification Search
USPC ..... 430/108.1–109.3
See application file for complete search history.

(56) References Cited

U.S. PATENT DOCUMENTS

| | | | | |
|---|---|---|---|---|
| 7,550,242 | B2 | 6/2009 | Nozaki et al. | |
| 7,556,904 | B2 | 7/2009 | Kadota et al. | |
| 2005/0014079 | A1 * | 1/2005 | Itakura et al. | 430/45 |
| 2005/0186497 | A1 | 8/2005 | Moribe et al. | |
| 2005/0250036 | A1 * | 11/2005 | Emoto et al. | 430/109.2 |
| 2005/0277044 | A1 * | 12/2005 | Watanabe et al. | 430/109.3 |
| 2005/0277045 | A1 * | 12/2005 | Saito et al. | 430/109.3 |
| 2006/0121384 | A1 * | 6/2006 | Patel et al. | 430/109.3 |
| 2006/0210902 | A1 | 9/2006 | Nakamura et al. | |
| 2006/0240352 | A1 | 10/2006 | Ogawa et al. | |
| 2007/0026335 | A1 | 2/2007 | Yamamoto et al. | |
| 2007/0059625 | A1 | 3/2007 | Yamamoto et al. | |
| 2007/0105033 | A1 | 5/2007 | Moribe et al. | |
| 2007/0166635 | A1 | 7/2007 | Yamamoto et al. | |
| 2007/0190442 | A1 | 8/2007 | Nakamura et al. | |
| 2007/0207399 | A1 | 9/2007 | Kadota et al. | |

(Continued)

FOREIGN PATENT DOCUMENTS

| | | | |
|---|---|---|---|
| JP | 10-198066 | A | 7/1998 |
| JP | 2002-169336 | A | 6/2002 |

(Continued)

OTHER PUBLICATIONS

U.S. Appl. No. 12/398,541, filed Mar. 5, 2009, Atsushi Yamamoto, et al.

Office Action issued Jan. 10, 2013, in Japanese Patent Application No. 2008-238467.

*Primary Examiner* — Mark F Huff
*Assistant Examiner* — Rashid Alam
(74) *Attorney, Agent, or Firm* — Oblon, Spivak, McClelland, Maier & Neustadt, L.L.P.

(57) ABSTRACT

The toner includes at least a binder resin, and a colorant. The toner has properties such that the percentage W(3000) of components having a molecular weight of 3,000 or less in tetrahydrofuran-soluble components of the toner determined by a GPC-RALLS viscosity analysis is 20% by weight or less; the molecular weight Mp at the peak top of the main peak in the molecular weight distribution curve of the tetrahydrofuran-soluble components is from 4,000 to 10,000; and the ratio Rt(Mp)/Rs(Mp) of an inertia square radius Rt(Mp) at the molecular weight Mp to an inertia square radius Rs(Mp) of linear polystyrene at the molecular weight Mp is greater than 0.98, wherein the inertia square radius Rs(Mp) is determined from a working curve obtained by subjecting plural polystyrenes having different molecular weights to the GPC-RALLS viscosity analysis.

19 Claims, 3 Drawing Sheets

U.S. PATENT DOCUMENTS

| | | | | |
|---|---|---|---|---|
| 2007/0212630 | A1 | 9/2007 | Yasunaga et al. | |
| 2007/0218384 | A1 | 9/2007 | Matsumoto et al. | |
| 2007/0218388 | A1 | 9/2007 | Kurose et al. | |
| 2007/0218393 | A1 | 9/2007 | Nozaki et al. | |
| 2008/0032223 | A1 | 2/2008 | Yamamoto et al. | |
| 2008/0038656 | A1 | 2/2008 | Yasunaga et al. | |
| 2008/0069617 | A1 | 3/2008 | Matsumoto et al. | |
| 2008/0081273 | A1 | 4/2008 | Murakami et al. | |
| 2008/0131797 | A1 | 6/2008 | Ishikawa et al. | |
| 2008/0176159 | A1 | 7/2008 | Matsumoto et al. | |
| 2008/0232857 | A1 | 9/2008 | Matsumoto et al. | |
| 2008/0299482 | A1* | 12/2008 | Kato et al. | 430/113 |
| 2009/0220879 | A1 | 9/2009 | Matsumoto et al. | |

FOREIGN PATENT DOCUMENTS

| | | | |
|---|---|---|---|
| JP | 2005-156824 | A | 6/2005 |
| JP | 2005-266789 | | 9/2005 |
| JP | 2006-337872 | A | 12/2006 |
| JP | 2007-127920 | | 5/2007 |
| JP | 2007-148399 | | 6/2007 |
| JP | 2007-286562 | | 11/2007 |
| JP | 2008-96624 | | 4/2008 |
| JP | 2008-129308 | A | 6/2008 |
| JP | 2008-170836 | A | 7/2008 |

* cited by examiner

TONER, AND IMAGE FORMING METHOD AND APPARATUS USING THE TONER

BACKGROUND OF THE INVENTION

1. Field of the Invention

The present invention relates to a toner for use in developing an electrostatic latent image. In addition, the present invention also relates to an image forming method and an image forming apparatus, which produce images using the toner.

2. Discussion of the Background

Electrophotographic image forming methods typically include the following processes:

(1) charging a surface of a photoreceptor, which serves as an image bearing member, by causing an electric discharging (charging process);
(2) irradiating the charged photoreceptor with imagewise light to form an electrostatic latent image on the surface of the photoreceptor (light irradiating process);
(3) developing the electrostatic latent image with a developer including a toner to form a toner image on the photoreceptor (developing process);
(4) transferring the toner image onto a receiving material (transferring process);
(5) fixing the toner image on the receiving material (fixing process); and
(6) cleaning the surface of the photoreceptor after transferring the toner image (cleaning process).

In the fixing process, a method in which a receiving material sheet bearing a toner image thereon is fed through the nip between a pair of rollers, at least one of which is a heat roller, so that the toner image is fixed on the receiving material sheet, is typically used.

In the fixing process, it is preferable in view of energy saving that toner images are well fixed at a low fixing temperature. Therefore, it is preferable to use a low-temperature fusible toner, which can fuse at a low fixing temperature. However, such a low-temperature fusible toner typically has poor preservation stability, and poor resistance to physical stresses caused by shaking, rubbing, agitating, etc. Namely, low temperature fixability of toner, and the preservation stability and stress resistance of the toner establish a trade-off relationship.

Recently, a strong need exists for an electrophotographic image forming apparatus, which has a small size and can produce images at a high speed. Therefore, a need exists for a toner which has a good combination of low temperature fixability, preservation stability and stress resistance. In attempting to fulfill the need, various techniques have been proposed. One of the techniques is to use a toner in which the inertia square radius of the binder resin components of the toner falls in a specific range.

For example, a published unexamined Japanese patent application No. (hereinafter referred to as JP-A) 2005-266789 corresponding to US2005186497A1 discloses a toner including a styrene resin having properties such that when the o-dichlorobenzene-soluble components of the resin is subjected to a viscosity analysis using a high temperature GPC-Ralls-viscometer, the absolute molecular weight Mw of the components is from $1.0\times10^3$ to $1.0\times10^5$, the ratio of components having an absolute molecular weight Mw of not greater than 10,000 is from 40 to 90% by weight, the ratio of components having an absolute molecular weight Mw of not less than 1,000,000 is less than 10% by weight, and the intrinsic viscosity of the components is from 0.10 to 0.80 ml/g. In addition, the average molecular size Rw (i.e., inertia radius R) of the styrene resin is preferably not greater than 1 nm. It is described therein that when the absolute molecular weight Mw and the ratios are lower than the specific ranges, the melt viscosity of the resin seriously decreases. In contrast, when the absolute molecular weight Mw and the ratios are higher than the specific ranges, the melt viscosity of the resin seriously increases. In addition, it is described therein that when the ratio of components having an absolute molecular weight Mw of not less than 1,000,000 is not less than 10% and the inertia radius is greater than 1 nm, the fixability of the toner deteriorates.

JP-A 2007-286562 corresponding to US2006240352A1 discloses a toner including, as a binder resin, a hybrid resin in which a polyester resin and a vinyl resin are chemically bonded, wherein the polyester unit is included in the resin in an amount of not less than 50% by weight. In addition, the resin includes tetrahydrofuran (THF)-insoluble components in an amount of from 3 to 50% by weight, and THF-soluble components (polyester resin components) obtained by hydrolyzing the THF-insoluble components have molecular weight distribution properties determined by gel permeation chromatography (GPC) such that a main peak is present in a range of from 50,000 to 500,000 and components having an absolute molecular weight Mw of not less than $1.0\times10^7$ have an inertia square radius of from 50 to 100 nm. Namely, the point of this application is that the size of resin components having an extremely high molecular weight is not too large (i.e., the molecules spread medially).

In addition, JP-As 2007-127920 and 2008-96624 have disclosed techniques such that the inertia square radius of the binder resin components of toner are specified.

JP-A 2007-148399 corresponding to US2007105033A1 discloses a toner having properties such that when the THF-soluble components obtained by dissolving the toner in tetrahydrofuran (THF) for 24 hours at 25° C. are subjected to a GPC-Ralls viscosity analysis, the inertia square radius (Rt) at the peak top of a main peak is from 1.0 to 3.8 nm, and the ratio (Rt/Rp) of the inertia square radius (Rt) to the inertia square radius (Rp) of linear polystyrene having the same peak molecular weight is not greater than 0.8. The point of the application is that the low molecular weight components of the resin preferably are preferably branched, and thereby the binder resin can well entwine with other toner constituents, resulting in improvement of fixing property of the toner.

Thus, various techniques have been proposed in attempting to improve the low temperature fixability of toner. However, the trade-off between the low temperature fixability, and mechanical strength and heat resistance (high temperature preservability) cannot be solved. In the cases where toner images are fixed at a relatively narrow nip while a relatively high pressure is applied thereto (such as roller fixing methods) or toner images are fixed at a relatively high speed using a belt (belt fixing methods), the toner is preferably melted in a short time. In addition, in order to prepare glossy images, the toner preferably has a low melt viscosity. However, the melt viscosity of toner is too low, the hot offset resistance of the toner deteriorates.

Until now, the following methods have been typically used for improving the low temperature fixability of toner.

(1) The glass transition temperature of the toner (binder resin) is decreased;
(2) The molecular weight of the binder resin is decreased; and/or
(3) A crystalline resin is used as a binder resin.

When the method (1) is used, the high temperature preservability of the toner deteriorates. When the method (2) is used, hot offset resistance of the toner deteriorates and image forming members (such as photoreceptors) are contaminated because the toner is deformed and fused by an external force. In this case, a toner film is formed on the image forming members and thereby abnormal images such as images having a rice-fish form are produced. When the method (3) is used, the kneaded toner constituent mixture is pulverized at interfaces between the crystalline resin and other components, resulting in occurrence of contamination of image forming members.

Thus, conventional toners could not solve the trade-off problem.

Because of these reasons, a need exists for a toner having a good combination of fixability, preservation stability and stress resistance.

SUMMARY OF THE INVENTION

As an aspect of the present invention, a toner is provided, which includes at least a binder resin and a colorant, and satisfies the following relationships (1)-(3):

$$W(3000) \leqq 20\% \text{ by weight} \quad (1);$$

$$4000 \leqq Mp \leqq 10000 \quad (2); \text{ and}$$

$$Rt(Mp)/Rs(Mp) > 0.98 \quad (3),$$

wherein W(3000) represents the percentage of components having a molecular weight of not higher than 3,000 in tetrahydrofuran-soluble components of the toner, which is determined by subjecting the tetrahydrofuran-soluble components to a GPC-RALLS viscosity analysis; Mp represents the molecular weight at the peak top of the main peak in the molecular weight distribution curve of the tetrahydrofuran-soluble components obtained by the GPC-RALLS viscosity analysis; Rt(Mp) represents the inertia square radius at the molecular weight Mp; Rs(Mp) represents the inertia square radius of linear polystyrene at the absolute molecular weight Mp, which is determined from a working curve obtained by subjecting plural linear polystyrenes having different molecular weights to the GPC-RALLS viscosity analysis.

As another aspect of the present invention, an image forming apparatus is provided, which includes:

an image bearing member configured to bear an electrostatic latent image thereon;

a charging device configured to charge the image baring member;

a light irradiating device configured to irradiate the charged photoreceptor with imagewise light to form the electrostatic latent image thereon;

a developing device configured to develop the electrostatic latent image with a developer including the toner mentioned above to prepare a toner image on the image bearing member, wherein the developing device includes a developer containing portion containing the developer therein, a developing roller configured to bear the developer and to transport the developer to a development region to develop the electrostatic latent image with the developer, and a developer supplying roller configured to supply the developer in the developer containing portion to the developing roller;

a transferring device configured to transfer the toner image onto a receiving material; and a fixing device configured to fix the toner image on the receiving material.

As yet another aspect of the present invention, an image forming method is provided, which includes:

forming an electrostatic latent image on an image bearing member;

developing the electrostatic latent image with a developer including the toner mentioned above to prepare a toner image on the image bearing member;

transferring the toner image onto a receiving material; and fixing the toner image on the receiving material.

The electrostatic latent image forming step preferably includes:

charging an image bearing member; and irradiating the charged photoreceptor with imagewise light to form the electrostatic latent image thereon.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
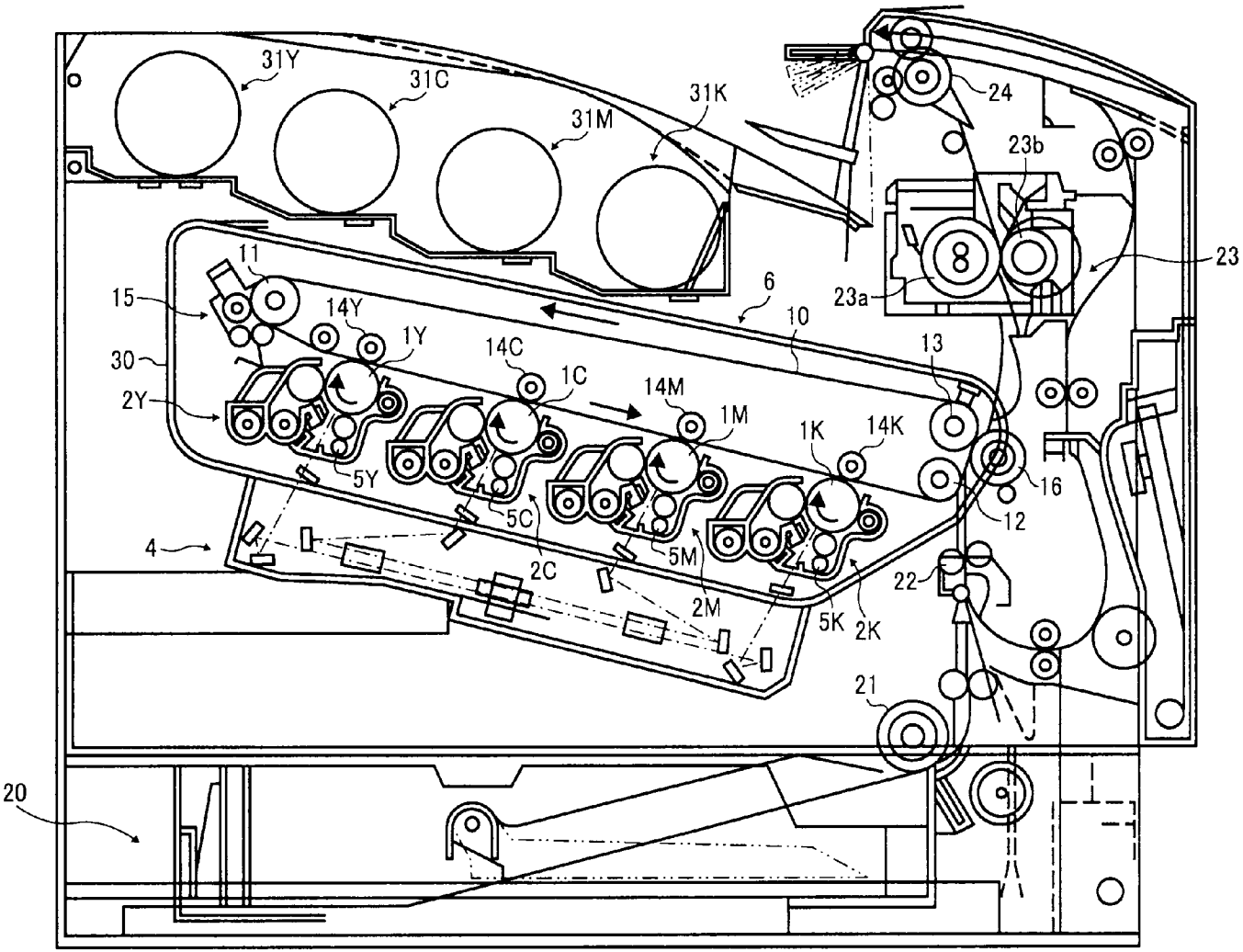
FIG. 1 illustrates an example of the image forming apparatus of the present invention.

At first, the toner of the present invention will be explained.

As a result of the present inventors' investigation of solving the problems mentioned above, the following is discovered.

Specifically, by using a resin having a rigid and linear skeleton as a low molecular weight component of the binder resin of the toner, the molecular chains are oriented to each other when the resin (toner) is in a solid state. Therefore the resin is tougher than conventional resins having the same molecular weights. In addition, when a part of the low molecular weight component has a skeleton similar to a part of the skeleton of a high molecular weight component of the binder resin, the low molecular weight component is properly compatible with the high molecular weight component. Therefore, the components do not form interfaces therebetween, thereby preventing occurrence of a problem in that when toner particles are agitated in a developing device, the toner particles easily break at interfaces between the high molecular weight component and the low molecular weight component, resulting in formation of fine particles.

In addition, in a liquid state (i.e., melted state), molecules of the low molecular weight component hardly entwine with each other, and therefore the melted low molecular weight component has a low melt viscosity, resulting in decrease of the melt viscosity of the toner. Accordingly, toner images fixed by a heat and pressure fixing method have a high glossiness.

Thus, by using a resin having a rigid and linear skeleton as a low molecular weight component of the binder resin of toner, the toner has a low melt viscosity and a good combination of high temperature preservability and stress resistance, and can produce glossy images even when toner images are fixed at a high fixing speed.

Thus, the above-mentioned problems are solved by the toner, which includes at least a binder resin and a colorant, and satisfies the following relationships (1)-(3):

$$W(3000) \leqq 20\% \text{ by weight} \quad (1);$$

$$4000 \leqq Mp \leqq 10000 \quad (2); \text{ and}$$

$$Rt(Mp)/Rs(Mp) > 0.98 \quad (3),$$

wherein W(3000) represents the percentage of components having a molecular weight of not higher than 3,000 in tetrahydrofuran (THF)-soluble components of the toner, which is determined by subjecting the THF-soluble components to a GPC-RALLS viscosity analysis; Mp represents the peak top molecular weight at the peak top of the main peak in the molecular weight distribution curve of the THF-soluble components obtained by the GPC-RALLS viscosity analysis; Rt(Mp) represents the inertia square radius at the peak top molecular weight Mp; Rs(Mp) represents the inertia square radius of linear polystyrene at the peak top molecular weight Mp, which is determined from a working curve obtained by subjecting plural linear polystyrenes having different molecular weights to the GPC-RALLS viscosity analysis.

The toner of the present invention will be explained in detail.

The rigidity and linearity of a resin can be well represented by the ratio Rt(Mp)/Rs(Mp).

In this regard, Rt(Mp) represents the inertia square radius of the THF-soluble components of the toner at the peak top molecular weight Mp thereof; Rs(Mp) represents the inertia square radius of linear polystyrene at the absolute molecular weight Mp, which is the same as the above-mentioned peak top molecular weight Mp, wherein the inertia square radius Rs(Mp) is determined from a working curve obtained by subjecting plural linear polystyrenes having different molecular weights to the GPC-RALLS viscosity analysis.

With respect to polymers having the same molecular weight, it is generally said that polymers having a large number of branched structures or crosslinked structures have less degree of freedom in movement of the polymer chain, and therefore the inertia square radius (i.e., the size of molecules) of the polymers is small. In contrast, polymers having a small number of branched structures or crosslinked structures have higher degree of freedom in movement of the polymer chain, and therefore the inertia square radius (i.e., the size of molecules) of the polymers is large.

The inertia square radius of a polymer represents the size (i.e., the degree of spreading) of the polymer chain of the polymer in a solution. Therefore, the inertia square radius changes depending on the solvent used for dissolving the polymer. However, when tetrahydrofuran (THF) is used as the solvent, the inertia square radius of a polymer is considered to be almost the same as that in the case where the polymer is present in a toner, because THF can dissolve greater part of the polymer.

In the case of two polymers having a small number of branches or no branch, the inertia square radius of the polymers changes depending on the spreading of the random coil structures thereof in a solvent. For example, spreading of the random coil structures thereof in a solvent changes depending on the rigidity, linearity and polarity of the molecular chains of the polymers. With respect to the rigidity, the more the amount of a rigid unit (such as rings) included in the main chain of a polymer, the more rigid the polymer becomes. In addition, when a rigid polymer is randomly inflected, the inertia square radius of the polymer decreases. In contrast, when the rigid polymer has a linear structure, the inertia square radius of the polymer increases.

For example, polyacene is a polymer having an extremely high rigidity and linearity. If it is possible to measure the inertia square radius of polyacene, the inertia square radius is considered to be much larger than that of a linear polystyrene having the same molecular weight.

The present inventor discovers that when the ratio Rt(Mp)/Rs(Mp) is greater than 0.98, the resin components influencing the melting property of the binder resin in the fixing process have rigid and linear main chains, thereby producing the above-mentioned effects of the present invention.

The reason why the rigidity and linearity are discussed by reference to linear polystyrene is that many linear polystyrenes are available when preparing a working curve of styrene-conversion molecular weight. In other words, the value itself of inertia square radius of polystyrene is not important.

The reason why the inertia square radius at the peak top molecular weight Mp is specified is that the amount of the component having the molecular weight is largest among the components included in the toner, and thereby the properties of the toner depend on the structure of the component, which is considerably related to the inertia square radius of the component.

In order to produce the effects of the present invention, the peak top molecular weight (Mp) of the main peak of the THF-soluble components of the toner is from 4,000 to 10,000, preferably from 4,500 to 9,500, and more preferably from 5,000 to 9,000. When the peak top molecular weight (Mp) is too high, the viscosity of the melted toner in the fixing process seriously increases, resulting in occurrence of problems in that the fixing property of toner images deteriorate and the glossiness of the fixed toner images decreases.

In contrast, when the peak top molecular weight (Mp) is too low, the THF-soluble components become brittle even when the components have a highly rigid and linear structure, resulting in deterioration of toughness of toner particles. Therefore, when the toner repeatedly receives a stress such as frictional stress in an image forming apparatus (particularly in a developing device), the toner particles break, resulting in formation of fine toner particles. In this case, the fine toner particles adhere to other members such as the image bearing member and parts of the developing device, resulting in contamination of the members, thereby forming abnormal images such as white spot images such that white spots are formed in a solid image, and background fouling such that the background of images is soiled with such fine toner particles.

In addition, the toner of the present invention preferably has a storage modulus G'(150) of from $3.0\times10^3$ to $1.4\times10^4$ at 150° C. When the storage modulus is too low, a hot offset problem in that the toner adheres to a fixing member because the toner has too low an elasticity in the fixing process is caused. In contrast, when the storage modulus is too high, problems in that fixed toner images have low mechanical strength and/or low glossiness because the toner has too high an elasticity in the fixing process are caused.

Further, it is preferable that the binder resin includes components having a molecular weight of not greater than 3,000 in an amount of not greater than 20% by weight, preferably not greater than 18% by weight, and more preferably not greater than 15% by weight based on the total weight of the binder resin.

When the content of components having a molecular weight of not greater than 3,000 is too high, the high temperature preservability of the toner deteriorates or a problem in that toner particles are broken or deformed in the developing process due to brittleness of the toner, resulting in formation of fine particles, thereby contaminating other members such as photoreceptors and parts of developing devices and forming abnormal images such as images having a rice-fish form is caused. In addition, when toner particles are broken or deformed, the charge properties and fluidity of the toner change, and thereby the various problems are caused. Specifically, when toner particles are not sufficiently charged, images with background fouling are formed. When the fluidity of the toner deteriorates, the toner cannot be sufficiently fed to the developing device, resulting in formation of abnormal images such as low density images. In addition, a higher torque is needed to feed and agitate the toner. In this case, frictional heat is generated, resulting in agglomeration of toner particles and deterioration of image qualities.

In particular, the problems caused by the brittleness of the toner are remarkably caused when the toner is used for a one component developing method, i.e., when the toner is scraped by a developer layer thickness controlling member such as blades.

In order to prepare the toner of the present invention, it is preferable to use at least two kinds of resins (A) and (B) as the binder resin of the toner. Specifically, the first resin (A) is a relatively low molecular weight resin without a branched structure or a crosslinked structure. The second resin (B) is a resin having a higher molecular weight than the first resin (A).

The first resin (A) improves penetration of the toner into a receiving material (such as papers) and smoothness of the surface of toner images. Since the toner of the present invention includes a low molecular weight resin component having a rigid skeleton (unit), the fixing property of the toner can be improved as mentioned above. In addition, when the toner is in a solid state, the rigid unit tends to orient, and thereby the toner is prevented from being brittle. Specifically, the toner of the present invention is less brittle than conventional toners even when the content of low molecular weight components in the toner of the present invention is the same as those in conventional toners, and the molecular weight of the low molecular weight components included in the toner of the present invention is relatively low compared to the low molecular weight components included in conventional toners.

However, extremely low molecular weight components, which have a molecular weight of not greater than 3,000, make the toner brittle. Therefore, it is preferable that the content of such extremely low molecular weight components in the toner is as low as possible.

In order to prepare a low molecular weight resin including such extremely low molecular weight components in a relatively small amount, the following polymerization methods can be preferably used.

(1) A polymerization method in which a polymerization is not continuously performed, and polymerization is performed step by step to extend the length of the molecular chain while controlling the length, resulting in formation of a low molecular weight resin having a sharp molecular weight distribution; and (2) Another polymerization method in which after a resin having a relatively low molecular weight is prepared using a conventional polymerization method for forming a low molecular weight resin, extremely low molecular weight components are removed therefrom.

From the viewpoint of productivity, the polymerization method (2) is preferably used.

Suitable resins for use as the low molecular weight resins for use in the toner of the present invention include polyester resins, polyurethane resins, polyurea resins, epoxy resins, vinyl resins, copolymers (random, block and graft copolymers) of these resins. Among these resins, polyester resins are more preferably used because of having good flexibility in binder-resin designing (i.e., the properties of the resins can be easily changed so that the resins can be used as a binder resin).

In order to prepare polyester resins for use in the toner of the present invention, the following methods can be used.

(1) Methods in which a polyol and a polycarboxylic acid (or anhydrides or esters with a low molecular weight alcohol) are subjected to a dehydration reaction, a dealcoholization reaction or an ester exchange reaction; and (2) Methods in which lactone ring opening polymerization is performed.

It is preferable to use the methods (1) in view of flexibility in binder-resin designing (i.e., because the properties of the resins can be easily changed so that the resins can be used as a binder resin).

Polyols for use in preparing polyester resins for use in the toner of the present invention include diols and polyols having three or more hydroxyl groups. Specific examples of the diols include alkylene glycols (e.g., ethylene glycol, 1,2-propylene glycol, 1,3-propylene glycol, 1,4-butane glycol and 1,6-hexanediol); alkylene ether glycols (diethylene glycol, triethylene glycol, dipropylene glycol, polyethylene glycol, polypropylene glycol, and polytetramethyleneether glycol); alicyclic diols (e.g., 1,4-cyclohexane dimethanol, and hydrogenated bisphenol A); bisphenol compounds (e.g., 4,4'-dihydroxybiphenyl compounds (e.g., bisphenol A, bisphenol F, bisphenol S, and 3,3'-difluolo-4,4'-dihydroxybiphenyl), bis-hydroxyphenylalkane compounds (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (i.e., tetrafluorobisphenol A), and 2,2-bis(3-hydroxyphenyl)-1,1,1,3,3,3-hexafluoropropane), and bis(4-hydroxyphenyl) ether compounds (e.g., bis(3-fluoro-4-hydroxyphenyl)ether); adducts of the above-mentioned alicyclic diols with an alkylene oxide such as ethylene oxides, propylene oxides and butylenes oxides; adducts of the above-mentioned bisphenols with an alkylene oxide such as ethylene oxides, propylene oxides and butylenes oxides; etc.

Among these diols, alkylene glycols having 2 to 12 carbon atoms, alkylene oxide adducts of bisphenols, and mixtures thereof are preferably used, and alkylene oxide adducts of bisphenols, and mixtures thereof with alkylene glycols having 2 to 12 carbon atoms, are more preferably used.

Polyols having three or more hydroxyl groups can also be used as polyols. Specific examples of such polyols include aliphatic polyalcohols having three or more hydroxyl groups (e.g., glycerin, triethylolethane, pentaerythritol, and sorbitol); phenolic compounds having three or more hydroxyl groups (e.g., trisphenol PA, phenol novolak and cresol novolac); and alkylene oxide adducts of the polyphenolic compounds mentioned above.

The polyols mentioned above can be used alone or in combination. In addition, the polyols used for forming polyester resins for use in the toner of the present invention are not limited to the polyols mentioned above.

Polycarboxylic acids for use in preparing polyester resins for use in the toner of the present invention include dicarboxylic acids and polycarboxylic acids having three or more carboxyl groups. Specific examples of dicarboxylic acids include alkylenedicarboxylic acids (e.g., succinic acid, adipic acid, and sebacic acid); alkenylenedicarboxylic acids (e.g., maleic acid and fumaric acid); aromatic dicarboxylic acids (e.g., phthalic acid, isophthalic acid, terephthalic acid, naphthalenedicarboxylic acid, 3-fluoroisophthalic acid, 2-fluoroisophthalic acid, 2-fluoroterephthalic acid, 2,4,5,6-tetrafluoroisophthalic acid, 2,4,5,6-tetrafluoroterephthalic acid, 5-trifluoromethylisophthalic acid, 2,2-bis(4-caboxyphenyl) hexafluoropropane, 2,2-bis(3-caboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, hexafluoroisopropylidenediphthalic anhydride, etc.

Among these materials, alkenylenedicarboxylic acids having 4 to 20 carbon atoms and aromatic dicarboxylic acids having 8 to 20 carbon atoms are preferably used.

Specific examples of the polycarboxylic acids having three or more carboxyl groups include aromatic polycarboxylic acids having 9 to 20 carbon atoms (e.g., trimellitic acid, and pyromellitic acid).

Anhydrides and lower alkyl esters (such as methyl, ethyl and isopropyl esters) of the above-mentioned polycarboxylic acids can also be used as the polycarboxylic acids to be reacted with polyols.

The polycarboxylic acids mentioned above can be used alone or in combination. In addition, the polycarboxylic acids used for forming polyester resins for use in the toner of the present invention are not limited to the polycarboxylic acids mentioned above.

In order to prepare low molecular weight polyester resins for use in the toner of the present invention, monomers (polyols and polycarboxylic acids) having a rigid skeleton and a considerable linearity are preferably used. Suitable polyols for use in preparing such low molecular weight polyester resins include alicyclic diols, bisphenols, 4,4'-dihydroxybiphenyl compounds, bis(hydroxyphenyl)alkane compounds, and alkylene oxide adducts of these compounds. Among these compounds, alkylene oxide adducts of bisphenol A are preferably used in view of binder resin designing flexibility. Suitable polycarboxylic acids for use in preparing such low molecular weight polyester resins include alkenylene dicarboxylic acids, and aromatic dicarboxylic acids. Among these polycarboxylic acids, terephthalic acid, 2,2'-naphthalenedicarboxylic acid and 2-fluoroterephthalic acid are preferably used.

In the present application, the rigid structure means a structure in which movement of atoms of a molecule is restricted due to a bond included in the molecule.

Specific examples of the groups having good rigidity include hydrocarbon groups such as arylene groups (e.g., phenylene and naphtylene groups), cycloalkylene groups (e.g., cyclobutylene, cyclopentylene, and cyclohexylene groups), crosslinked hydrocarbon ring groups (e.g., norbornylene and adamantylene groups), alkenylene groups, alkynylene groups, etc. With respect to alkylene groups, propylene groups and polypropylene groups are relatively rigid compared to ethylene groups and polyethylene groups.

In addition, urea, urethane, amide, imide, thiourea, thiourethane, thioamide, and thioimide groups are also rigid groups.

Among these groups, specific examples of groups having considerable linearity are groups having a large bond angle. Specific examples thereof include the following groups.

(1) Arylene Groups 1,4-phenylene group, 1,5-naphthylene group, 2,6-naphthylene group, and 2,7-naphthylene group.

(2) Cycloalkylene Groups 1,3-cyclobutylene group, 1,3-cyclopentylene group, and 1,4-cyclohexylene group.

(3) Crosslinked Hydrocarbon Ring Groups 1,4-norbornylene group, 2,5-norbornylene group, 1,5-adamantylene group, and 2,6-adamantylene group.

Specific examples of the polyol monomers having such rigid groups having considerable linearity include alicyclic diols, bisphenol compounds, 4,4'-dihydroxybiphenyl compounds, bis(hydroxyphenyl)alkane compounds, and alkylene oxide adducts of these compounds. Among these compounds, alkylene oxide adducts of bisphenol A are preferably used in view of binder resin designing flexibility.

Specific examples of the polycarboxylic acid monomers having such rigid groups having considerable linearity include alkenylenedicarboxylic acids, and aromatic dicarboxylic acids. Specifically, terephthalic acid, 2,6-naphthalenedicarboxylic acid, and 2-fluoroterephthalic acid are preferably used.

Specific examples of the methods for removing extremely low molecular weight components from a resin obtained from the above-mentioned monomers include the following method (i.e., re-precipitation method).

A resin is dissolved in a good solvent A which can well dissolve the resin. Next, a solvent B, which can dissolve only extremely low molecular weight components of the resin (i.e., which cannot dissolve the high molecular weight components of the resin) and which can be compatible with the solvent A, is added to the solution little by little, resulting in precipitation of high molecular weight components. After the precipitate is removed from the mixture, the precipitate is dried to prepare a resin, from which extremely low molecular weight components are removed.

In this regard, proper solvents for use as the solvents A and B change depending on the resin. When the resin is polyester resins, specific examples of the solvent A include tetrahydrofuran, ethyl acetate, butyl acetate, isopropyl acetate, acetone, methyl ethyl ketone, N,N-dimethylformamide, dimethylsulfoxide, hexafluororoisopropanol, chloromethane, methylene chloride, chloroform, and carbon tetrachloride and specific examples of the solvent B include water, methanol, ethanol, and isopropanol.

The added amount of the solvent A is determined in such a way that the solvent can dissolve the entire resin and the solution of the resin has a considerably low viscosity. When the viscosity of the resin solution is too high, the solution cannot be well mixed with the solvent B in the precipitation process. Specifically, the added amount of the solvent A is from 1 to 10 times (by weight) the amount of the resin. The solvent B is added to the resin solution (i.e., mixture of the resin and the solvent A) in an excess amount. When the added amount of the solvent B is too small, the resin cannot be fully precipitated by the solvent B. Specifically, the added amount of the solvent B is from 10 to 100 times (by weight) the amount of the resin solution.

The binder resin of the toner of the present invention includes a relatively high molecular weight resin so that toner images melted in the fixing process have a proper elasticity, resulting in prevention of occurrence of the hot offset problem in that part or entire of a toner image is adhered to the fixing member, and the adhered toner image is then transferred onto another portion of the image or another image, resulting in formation of an abnormal image.

Specific examples of the high molecular weight resins include polyester resins, polyurethane resins, polyurea resins, epoxy resins, vinyl resins, block and graft copolymers in which two or more of these resins are chemically bonded as units, etc.

Among these high molecular weight resins, resins having a polyester unit are preferably used. More specifically, resins having a polyester unit include polyester resins, resins in which polyester units are chemically connected, and hybrid resins in which a polyester unit is chemically connected with a vinyl resin unit are preferably used in view of binder resin designing flexibility, productivity and manufacturing costs.

The high molecular weight resin for use in the toner of the present invention preferably includes a branched structure or a crosslinked structure to impart good elasticity to the toner.

Resins in which polyester units are chemically connected can be prepared by subjecting a polyester prepolymer (i.e., a polyester precursor) having a reactive functional group at the end portion thereof to a reaction. Specific examples of the polyester prepolymers include isocyanate modified polyesters and amino modified polyesters, in which an isocyanate group or an amino group is incorporated at the end portion thereof.

Specific examples of the isocyanate modified polyesters include reaction products which are obtained by reacting a polyester having a group having an active hydrogen atom with a polyisocyanate. Specific examples of the group having an active hydrogen atom include hydroxyl groups (such as alcoholic hydroxyl groups and phenolic hydroxyl groups), amino groups, carboxyl groups, mercapto groups, etc. Among these groups, alcoholic hydroxyl groups are preferable.

Specific examples of the polyisocyanates for use in preparing modified polyester resins include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., $\alpha, \alpha, \alpha', \alpha'$-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio of a polyisocyanate to a polyester having a hydroxyl group (i.e., the equivalence ratio [NCO]/[OH]) of the [NCO] group of a polyisocyanate to the [OH] group of a polyester) is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the crosslinking density of the extended and/or crosslinked modified polyesters decreases, thereby deteriorating the hot-offset resistance of the toner.

The content of the polyisocyanate unit in the polyester prepolymer (A) having an isocyanate group is from 0.5 to 40% by weight, preferably from 1 to 30% by weight and more preferably from 2 to 20% by weight. When the content is too low, the hot offset resistance of the toner deteriorates. In contrast, when the content is too high, the low temperature fixability of the toner deteriorates.

The average number of the isocyanate group included in a molecule of the isocyanate modified polyester is generally not less than 1, preferably from 1.5 to 3, and more preferably from 1.8 to 2.5. When the average number of the isocyanate group is too small, the molecular weight of the resultant isocyanate modified polyester, which is crosslinked and/or extended, decreases, thereby deteriorating the hot offset resistance of the resultant toner.

Amino modified polyesters are prepared by a method (A) in which a polyester having a carboxyl group is reacted with an amine having a functional group which can react with the carboxyl group; another method (B) in which a polyester having a hydroxyl group (alcohol group) is reacted with an amine having a functional group which can react with the hydroxyl group; or the like methods. Among these methods, the method (A) is preferably used because the reaction can be easily performed.

Suitable amines for use in preparing the amino modified polyesters include compounds having one of the following formula (C1) or (C2):

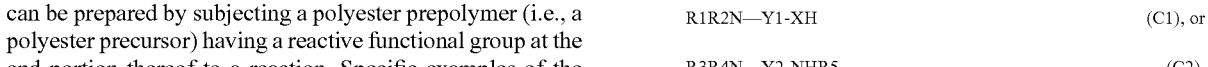

$$R1R2N—Y1-XH \quad (C1), \text{ or}$$

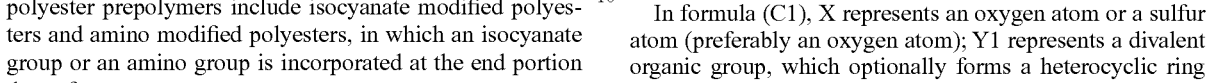

$$R3R4N—Y2-NHR5 \quad (C2).$$

In formula (C1), X represents an oxygen atom or a sulfur atom (preferably an oxygen atom); Y1 represents a divalent organic group, which optionally forms a heterocyclic ring together with the adjacent nitrogen atom; and each of R1 and R2 represents a hydrogen atom, or a saturated or unsaturated hydrocarbon group having from 1 to 8 carbon atoms, which is linear or branched.

When a carboxyl group located at the end of a polyester is reacted with an amine having formula (C1), a reaction represented by the following formula (1) is performed.

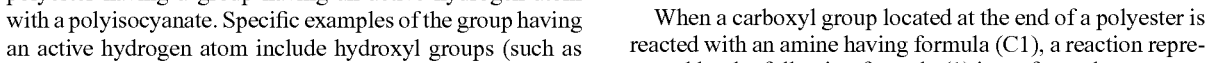

$$\text{(Polymer)-COOH}+R1R2N—Y1-XH \rightarrow \text{(Polymer)-COX}—Y1-NR1R2+H_2O \quad (1)$$

Specifically, as illustrated in formula (1), the group XH and the carboxyl group cause a dehydration reaction to form an ester or a thio-ester (i.e., a polyester resin) having an amino group at the end thereof. When one of R1 and R2 is a hydrogen atom, the carboxyl group is reacted with the amino group instead of the group XH depending on the structure of the amine used. In this case, a polyester having a group XH at the end thereof is prepared. In order that the resultant resin has no interaction with a polyester resin having an anionic functional group, it is preferable that each of R1 and R2 is a methyl or ethyl group.

Amine compounds having formula (C2) have two amino groups having different reactivities. In formula (C2), Y2 represents a divalent organic group; and each of R3, R4 and R5 is a hydrogen atom, or a saturated or unsaturated hydrocarbon group having from 1 to 8 carbon atoms, which is linear or branched. At least two of R3, Y2 and R5 may have covalent bond connectivity. The reactivity of amino groups can be changed by changing the size or the number of the substituents of the amino groups, or changing the degree of the steric hindrance of the amino groups.

When a carboxyl group located at the end of a polyester is reacted with an amine having formula (C2), a reaction represented by the following formula (2) is performed.

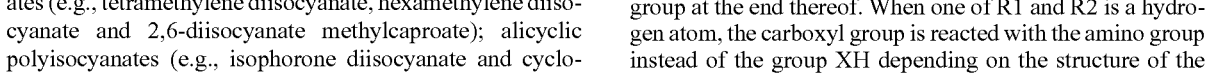

$$\text{(Polymer)-COOH}+R3R4N—Y2-NR5H \rightarrow \text{(Polymer)-CONR5}-Y2-NR3R4+H_2O \quad (2)$$

When the two amino groups of an amine having formula (C2) are equivalent or have the same reactivity, the amino group (i.e., —NR3R4) located at the end of the produced polyester resin is further reacted with a carboxyl group which is not yet reacted, resulting in occurrence of a chain reaction. Therefore, a polyester resin having an extremely high molecular weight is produced. In addition, when the polyester to be reacted has many branched chains, a polyester resin having a high crosslinking density is produced. In this case, the resultant polyester is hardly compatible with a polyester having an anionic functional group and another polyester resin, resulting in deterioration of the toughness of the toner. In addition, a problem in that the resultant polyester resin cannot be dissolved in an organic solvent, and thereby the toner cannot be prepared occurs. Therefore, it should be carefully performed to select an amine compound having formula (C2). Specifically, it is preferable that steric hindrance of the amine compound is controlled by adjusting the molecular structure. If such controlling cannot be performed, it is preferable to use amine compounds in which at least one of R3 and R4 is a methyl or ethyl group and R5 is a hydrogen atom.

The reactions (1) and (2) are preferably performed under the following conditions:

(1) Atmosphere: Inert gas atmosphere (such as nitrogen atmosphere):

(2) Reaction temperature: 100 to 280° C., preferably 110 to 240° C.

(3) Reaction time: Not shorter than 30 minutes, preferably 2 to 48 hours (4) Catalyst: Optionally used.

Specific examples of the catalyst include tin-containing catalysts (e.g., dibutyltin oxide), antimony trioxide, titanium-containing catalysts (e.g., titanium alkoxide, potassium oxalate titanate, titanium terephthalate, catalysts disclosed in JP-A 2006-243715, and catalysts disclosed in JP-A 2007-11307), zirconium-containing catalysts (e.g., zirconyl acetate), zinc acetate, pyridine, 4-dimethylaminopyridine, dicyclohexylcarbodiimide, 1-hydroxybenzotriazole, etc.

When a polyester resin is prepared by a condensation polymerization reaction and subsequently the polyester resin is subjected to the reaction (1) or (2), the catalyst used for the condensation polymerization reaction can also be used for the reaction (1) or (2) if the catalyst is not deactivated. Even in such a case, it is possible to use a catalyst, which is the same or different from the catalyst used for the condensation polymerization reaction, for the reaction (1) or (2) to enhance the reaction efficiency. Further, it is possible to perform the reaction (1) or (2) at a reduced pressure to remove water generated in the reaction, resulting in enhancement of the reaction efficiency.

Specific examples of the amines having formula (C1) include aminoethanol, N-methyl-2-aminoethanol, N,N-dimethyl-2-aminoethanol, N-ethyl-2-aminoethanol, N,N-diethyl-2-aminoethanol, N-methyl-N-ethyl-2-aminoethanol, 3-amino-1-propanol, 3-methylamino-1-propanol, 3-dimethylamino-1-propanol, 1-dimethylamino-2-propanol, 3-diethylamino-1-propanol, 1-diethylamino-2-propanol, 3-dimethylamino-2,2-dimethyl-1-propanol, etc.

Specific examples of the amines having formula (C2) include N-methylethylene diamine, N-ethylethylene diamine, N-isopropylethylene diamine, N-butylethylene diamine, N-hexylethylene diamine, N-octylethylene diamine, N,N-dimethylethylene diamine, N,N,N'-trimethylethylene diamine, N,N-diethyl-N'-methylethylene diamine, N,N,N'-triethylethylene diamine, N-methyl-1,3-diaminopropane, N-ethyl-1,3-diaminopropane, N-propyl-1,3-diaminopropane, N-butyl-1,3-diaminopropane, N-hexyl-1,3-diaminopropane, N-octyl-1,3-diaminopropane, 1-methylpiperadine, 1-ethylpiperadine, isophorone diamine, etc.

Among the amines having formula (1), N,N-dimethyl-2-aminoethanol is preferable in view of reactivity and availability. Among the amines having formula (2), isophorone diamine is preferable in view of reactivity and availability.

The high molecular weight resin included in the toner of the present invention imparts a proper elasticity to the toner melted in the fixing process, resulting in prevention of occurrence of the hot offset problem. However, when the content, molecular weight and/or crosslinking density of the high molecular weight resin are too high, the properties of the toner in the fixing process largely depend on the properties of the high molecular weight resin. Therefore, the function of the low molecular weight resin of penetrating the toner into receiving materials (papers), and the anchoring function thereof cannot be carried out. Accordingly, the content of the high molecular weight resin (components) is from 2 to 60% by weight, preferably from 5 to 50% by weight, and more preferably from 7 to 40% by weight, based on the total weight of the binder resin.

The binder resin of the toner of the present invention includes one or more low molecular weight resins, and one or more high molecular weight resins. The high molecular weight resin preferably includes a combination of a linear or slightly branched resin and a crosslinked resin.

The toner of the present invention includes at least a binder resin and a colorant (such as black, yellow, magenta and cyan colorants), and optionally includes other constituents such as release agents (such as waxes), charge controlling agents, antioxidants, fillers (particulate materials), and external additives (such as particulate materials serving as fluidizers). Waxes, and particulate materials can be included in the toner as internal additives and external additives.

The toner of the present invention can be prepared by a pulverization method, which includes mixing the toner constituents; melt-kneading the toner constituent mixture upon application of heat thereto; cooling the kneaded toner constituent mixture; pulverizing the kneaded toner constituent mixture; classifying the pulverized toner constituent mixture, resulting in preparation of a mother toner (toner particles).

The classifying process may be performed in parallel with the pulverizing process.

In addition to the physical methods (such as pulverization methods), the toner of the present invention can also be prepared by chemical methods such as drying granulation methods in which droplets of a solution prepared by dissolving a binder resin in a solvent are dried to form toner particles; solidification granulation methods in which an O/W emulsion is prepared and water is then removed therefrom to prepare toner particles; emulsion agglomeration methods in which an emulsion is prepared and the emulsion is agglomerated to prepare toner particles; suspension polymerization methods; and partial polymerization methods in which a precursor (such as polyester prepolymers) of a binder resin is subjected to an extension/crosslinking reaction in a liquid to prepare toner particles; and combinations of a physical method and a chemical method.

As mentioned above, the toner of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE Rs, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Pigments used as colorants may be subjected to surface modification. One example of such surface modification methods is as follows. A pigment is dispersed in a solvent, and then a surface modification agent is added to the dispersion. Next, the dispersion is heated to react the surface modification agent with the pigment. After the reaction, the treated pigment is separated by filtering. By repeatedly washing the pigment using the same solvent, followed by drying, a pigment whose surface is modified can be obtained.

Master batches, which are complexes of a colorant with a resin (binder resin), can be used as the colorant of the toner of the present invention.

Specific examples of the resins for use as the binder resin of the master batches include styrene polymers and substituted styrene polymers such as polystyrene, poly-p-chlorostyrene and polyvinyl toluene; copolymers of styrene (or substituted styrene) such styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above, and kneading the mixture while applying a high shearing force thereto. In this case, an organic solvent can be added to increase the interaction between the colorant and the resin. In addition, a flushing method, in which an aqueous paste including a colorant and water is mixed with a resin dissolved in an organic solvent, the mixture is kneaded to transfer the colorant to the resin side (i.e., the oil phase), and then the organic solvent (and water, if desired) is removed from the kneaded mixture, can be preferably used because the resultant wet cake can be used without being dried. When performing the mixing and kneading process, dispersing devices capable of applying a high shearing force such as three roll mills can be preferably used.

The toner of the present invention can include a wax as a release agent in combination with a binder resin and a colorant.

Known waxes can be used for the toner of the present invention. Specific examples of the waxes include polyolefin waxes such as polyethylene waxes and polypropylene waxes; hydrocarbons having a long chain such as paraffin waxes and SASOL waxes; and waxes having a carbonyl group. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkananoic acid esters are preferably used.

Among these waxes, waxes having a low polarity are preferably used for the toner of the present invention. Specific examples thereof include hydrocarbon waxes such as polyethylene waxes, polypropylene waxes, paraffin waxes, SAZOL waxes, microcrystalline waxes, and Fischer-Tropsch waxes.

The content of a wax in the toner is from 2 to 5% by weight based on the total weight of the toner. When the content is too low, the releasing effect cannot be well produced, and thereby the offset problem tends to be caused. In contrast, when the content is too high, the toner is easily affected by heat energy and mechanical energy because waxes are melted at a relatively low temperature. Therefore, when the toner is agitated in a developing device, a problem in that the wax exudes from the inside of the toner and the exuding wax is adhered to a developer thickness controlling member (such as blades) and an image bearing member (such as photoreceptors), resulting in formation of abnormal images occurs. In addition, when an image is formed on an OHP (overhead projection) sheet, a problem in that the wax extends outward from the edges of the image, resulting in projection of an abnormal image occurs.

The wax to be included in the toner of the present invention preferably has an endothermic peak at a temperature of from 60 to 90° C., and preferably from 65 to 80° C. when the waxes are subjected to differential scanning calorimetry (DSC) and the endothermic peak temperature is determined in the temperature rising process in the DSC. When the endothermic peak temperature is too low, the fluidity and high temperature preservability of the toner deteriorate. In contrast, when the endothermic peak temperature is too high, the fixability of the toner deteriorates.

In addition, the half width of the endothermic peak is preferably not greater than 8° C., and more preferably not greater than 6° C. When the half width of the peak is too wide (i.e., the endothermic peak is too broad), the fluidity and high temperature preservability of the toner deteriorate.

The toner of the present invention optionally includes a charge controlling agent. Known charge controlling agents for use in conventional toners can be used for the toner of the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and COPY CHARGE NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The toner of the present invention optionally includes an external additive to improve the fluidity, developing property and charging property of the toner. Suitable materials for use as external additives include particulate inorganic materials and particulate polymers.

Particulate inorganic materials for use as external additives preferably have a primary particle diameter of from 5 nm to 2 μm, and preferably from 5 nm to 500 nm. The surface area of the particulate inorganic materials is preferably from 20 to 500 $m^2/g$ when measured by a BET method.

The content of the particulate inorganic material in the toner is preferably from 0.01% to 5.0% by weight, and more preferably from 0.01% to 2.0% by weight, based on the total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as external additives of the toner of the present invention.

The external additives used for the toner of the present invention are preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylation agents, silane coupling agents having a fluorinated alkyl group, organic titanate coupling agents, aluminum coupling agents, silicone oils, modified silicone oils, etc.

In addition, the toner optionally includes a cleanability improving agent which can impart good cleaning property to the toner such that particles of the toner remaining on the surface of an image bearing member (such as photoreceptors) even after a toner image thereon is transferred can be easily removed therefrom. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods.

Such particulate resins for use as the cleanability improving agents preferably have a relatively narrow particle diameter distribution and a volume average particle diameter of from 0.01 μm to 1 μm.

Next, the method for preparing the toner of the present invention will be explained.

At first, the pulverization method will be explained. In the pulverization method, toner constituents including at least a binder resin and a colorant, and optionally including other constituents such as charge controlling agents and releasing agents (waxes) are mixed in a predetermined ratio. The toner constituent mixture is melted and kneaded upon application of heat thereto. After the kneaded toner constituent mixture is cooled, the kneaded mixture is pulverized. After the pulverizing process or at the same time as the pulverizing process, the pulverized toner constituent mixture is classified to prepare a mother toner (i.e., toner particles without external additives). In order to increase the average circularity of the resultant toner particles, the toner particles may be subjected to a shape controlling treatment in which a mechanical impact is applied to the toner particles using a machine such as HYBRIDIZER or MECHANO FUSION SYSTEM (manufactured by Hosokawa Micron Corp.) to control the shape of the toner particles.

The pulverization method will be explained in detail.

Suitable mixers for use in mixing the toner constituents include known mixers for use in mixing powders, which preferably have a jacket to control the inside temperature thereof. It is possible to change the mixing conditions such as rotation speed and rolling speed of the mixer, and mixing time and mixing temperature, to well mix the toner constituents. In addition, a mixing method in which at first a relatively high stress is applied and then a relatively low stress is applied to the toner constituents, or vice versa, can also be used.

Specific examples of the mixers include V-form mixers, locking mixers, LOEDGE MIXER, NAUTER MIXER, HENSCHEL MIXER and the like mixers.

The toner constituent mixture is then melted and kneaded using a kneader. Suitable kneaders for use in the melt-kneading process include batch kneaders such as roll mills; continuous double-axis kneaders such as KTK double-axis extruders from Kobe Steel, Ltd., TEM double-axis extruders from Toshiba Machine Co., Ltd., double-axis extruders from KCK Co., PCM double-axis extruders from Ikegai Corp., and KEX double-axis extruders from Kurimoto, Ltd.; continuous single-axis kneaders such as KO-KNEADER from Buss AG; etc.

The melt-kneading process is preferably performed under proper conditions such that the molecular chains of the binder resin are not cut in the kneading process.

In the pulverization process, the kneaded toner constituent mixture is pulverized. It is preferable that at first the kneaded toner constituent mixture is roughly pulverized, and then finely pulverized. In this pulverization process, methods in which particles of the toner constituent mixture are collided to a collision plate using jet air to be pulverized; methods in which particles of the toner constituent mixture are collided to each other using jet air to be pulverized; and methods in which particles of the toner constituent mixture are fed into a narrow gap formed by a rotor and a stator to be mechanically pulverized, can be preferably used.

In the classification process, the pulverized toner constituent mixture is classified to prepare particles having a predetermined particle diameter. In the classification process, for example, fine particles are removed using a machine such as cyclones, decanters, and centrifugal separators. In addition, the pulverized toner constituent mixture is classified in an air stream using centrifugal force.

The thus prepared mother toner can be mixed with an external additive such as particulate inorganic materials (e.g., hydrophobized silica) to improve the fluidity, preservability, developing property and transferring property of the toner.

Suitable mixers for use in mixing the mother toner with an external additive include known powder mixers which are equipped with a jacket to change the temperature of inside of the mixer. The stress applied to an external additive can be changed by a method in which a part of the external additive is fed to the mixer in the middle of the mixing process or a method in which the external additive is gradually fed to the mixer. Alternatively, it is possible to change the stress by changing the rotation speed or rolling speed of the mixer, mixing time, and mixing temperature. In addition, a mixing method in which at first a relatively high stress is applied and then a relatively low stress is applied to the external additive, or vice versa, can also be used.

Specific examples of the mixers for use in mixing the mother toner with an external additive include V-form mixers, locking mixers, LOEDGE MIXER, NAUTER MIXER, HENSCHEL MIXER and the like mixers.

It is preferable to sieve the mixture of the mother toner with an external additive using a screen with 250- or more-mesh to remove coarse particles and aggregated particles.

As mentioned above, not only pulverization methods (physical methods), but also chemical methods such as drying granulation methods in which droplets of a solution prepared by dissolving a binder resin in a solvent are dried to form toner particles; solidification granulation methods in which an O/W emulsion is prepared and water is then removed therefrom to prepare toner particles; emulsion agglomeration methods in which an emulsion is prepared and the emulsion is agglomerated to prepare toner particles; suspension polymerization methods; and partial polymerization methods in which a precursor (such as polyester prepolymers) of a binder resin is subjected to an extension/crosslinking reaction in a liquid to prepare toner particles, can also be used.

Among these chemical methods, emulsion agglomeration methods, suspension polymerization methods and partial polymerization methods will be explained in detail.

In the emulsion agglomeration methods, a toner, which includes at least a binder resin, a wax and a colorant, is prepared in an aqueous medium. The binder resin includes a vinyl resin obtained from a radically polymerizable monomer, and optionally includes other resins such as polyester resins. The emulsion agglomeration methods typically include the following processes:

(1) A resin emulsion obtained from a radically polymerizable monomer, a wax dispersion, a pigment dispersion, and an optional polyester resin emulsion, are agglomerated in an aqueous medium while heated to prepare particles (heating/fusing process);
(2) The aqueous medium including the particles is further heated to fuse the particles (second heating/fusing process); and
(3) The thus prepared particles are washed, followed by drying, resulting in formation of a mother toner (toner particles).

The vinyl resin obtained from a radically polymerizable monomer is not particularly limited, and one or more of any known vinyl resins can be used. The weight average molecular weight of the vinyl resins is preferably not higher than 50,000, and more preferably not higher than 30,000. When the weight average molecular weight is too high, the low temperature fixability of the toner deteriorates. The glass transition temperature of the vinyl resins is preferably from 40 to 80° C. When the glass transition temperature is too high, the low temperature fixability of the toner deteriorates. When the glass transition temperature is too low, the high temperature preservability of the toner deteriorates.

Vinyl resins can be prepared by polymerizing vinyl monomers. Specific examples of the vinyl monomers include:

(1) Hydrocarbons having a vinyl group such as aliphatic hydrocarbons and aromatic hydrocarbons;
(2) Vinyl monomers having a carboxyl group and salts thereof such as (meth)acrylic acid, maleic acid (or maleic anhydride), monoalkyl maleate, fumaric acid, monoalkyl fumarate, crotonic acid, itaconic acid, monoalkyl itaconate, itaconic acid glycol monoether, citraconic acid, monoalkyl citraconate, and dcinnamic acid;
(3) Vinyl monomers having a sulfonic group, sulfuric acid monoester having a vinyl group, and salts thereof;
(4) Vinyl monomers having a phosphate group and salts thereof;
(5) Vinyl monomers having a hydroxyl group;
(6) Nitrogen-containing vinyl monomers;
(7) Vinyl monomers having an epoxy group;
(8) Vinyl esters, vinyl (thio)ethers, vinyl ketones, and vinyl sulfone;
(9) Other vinyl monomers such as isocyanate ethyl (meth) acrylate, m-isopropenyl-α,α-dimethylbenzylisocyanate, and monomers having an alkyloxysilyl group; and
(10) Fluorine-containing vinyl monomers.

The polyester resin, which is optionally used for the emulsion agglomeration methods, is not particularly limited, and one or more of any known polyester resins can be used. In addition, by using a crystalline polyester resin, a good combination of high temperature preservability and low temperature fixability can be imparted to the toner.

Next, the suspension polymerization methods will be explained.

In the suspension polymerization methods, a liquid including a polymerizable monomer, and other toner constituents such as pigments and waxes is dispersed in an aqueous medium, and the mixture is subjected to a suspension polymerization to prepare particles, followed by washing and drying, resulting in formation of a mother toner.

In these methods, polar resins such as polyester resins can be added to the mixture, if desired. When the toner is directly prepared by a suspension polymerization method, a polar resin is preferably added to the mixture in the polymerization reaction process of from the dispersing process to the polymerization process. In this case, by controlling the balance between the polarities of the polymerizable monomer composition and the aqueous medium, toner particles in which the polar resin forms a thin film on the core particles, or toner particles in which the polar resin is present in the toner particles while the content of the polar resin is tapered from the surface of the particles to the inside thereof or vice versa, can be prepared. In this regard, by using a polar resin having an interaction with a colorant or a magnetic material (used for forming a magnetic toner), it is possible to control the existence state of the colorant or magnetic material in the resultant toner particles.

The added amount of such a polar resin is from 1 to 25 parts by weight, and preferably from 2 to 15 parts by weight, per 100 parts by weight of the binder resin. When the added amount of the polar resin is too small, the polar resin is unevenly present in the toner. This is not preferable. In contrast, when the added amount is too large, the thickness of the film of the polar resin formed on the surface of the toner particles seriously increases. This is also not preferable.

Specific examples of the polar resins include polyester resins, epoxy resins, styrene-acrylic acid copolymers, styrene-methacrylic acid copolymers, styrene-maleic acid copolymers, etc. Among these resins, polyester resins having a peak molecular weight of from 3,000 to 10,000 are preferable because the resultant toner particles have a good combination of fluidity, negative charging property, and transparency.

In order to improve the mechanical strength of the toner particles while controlling the molecular weight of the binder resin of the toner, crosslinking agents can be preferably used when synthesizing the binder resin.

Difunctional crosslinking agents and polyfunctional crosslinking agents can be used for form the binder resin.

Specific examples of the difunctional crosslinking agents include divinylbenzene, bis(4-acryloyloxypolyethoxyphenyl)propane, ethylene glycol di(meth)acrylate, 1,3-butylene glycol di(meth)acrylate, 1,4-butanediol di(meth)acrylate, 1,5-pentanediol di(meth)acrylate, 1,6-hexanediol di(meth) acrylate, neopentyl glycol di(meth)acrylate, diethylene glycol di(meth)acrylate, triethylene glycol di(meth)acrylate, tetraethylene glycol di(meth)acrylate, di(meth)acrylate of polyethylene glycols (#200, #400, and #600), dipropylene glycol di(meth)acrylate, polypropylene glycol di(meth)acrylate, di(meth)acrylate of polyester (e.g., MANDA from Nippon Kayaku Co., Ltd.), etc.

Specific examples of the polyfunctional crosslinking agents include pentaerythritol tri(meth)acrylate, trimethylolethane tri(meth)acrylate, trimethylolpropane tri(meth)acrylate, tetramethylolmethane tetra(meth)acrylate, origoester (meth)acrylate, 2,2-bis(4-methacryloyloxypoyethoxyphenyl)propane, diallylphthalate, triallyl cyanurate, triallyl isocyanurate, and triallyl trimellitate.

The added amount of such crosslinking agents is preferably from 0.05 to 10 parts by weight, and more preferably from 0.1 to 5 parts by weight, per 100 parts by weight of the monomers to be crosslinked.

When the toner of the present invention is prepared by a suspension polymerization method, a polymerization initiator can be used. Specific examples of the initiator include azo or diazo type polymerization initiators such as 2,2'-azobis-(2,4-dimethylvaleronitrile), 2,2'-azobisisobutylonitrile, 1,1'-azobis(cyclohexane-1-carbonitrile), and 2,2'-azobis-4-methoxy-2,4-dimethylvaleronitrile; peroxide type polymerization initiators such as benzoyl peroxide, methyl ethyl ketone peroxide, diisopropylperoxy carbonate, cumene hydroperoxide, 2,4-dichlorobenzoyl peroxide, and lauroyl peroxide; etc.

One or more proper initiators are selected in consideration of the polymerization method used and the half-life period thereof. The added amount of such an initiator, which is determined depending on the targeted polymerization degree, is typically 5 to 20 parts by weight per 100 parts by weight of the monomers to be polymerized.

When an aqueous medium for use in a suspension polymerization method is prepared, a dispersant is typically used. Any known inorganic and organic dispersants can be used as the dispersant. Specific examples of the inorganic dispersants include tricalcium phosphate, magnesium phosphate, aluminum phosphate, zinc phosphate, magnesium carbonate, calcium carbonate, calcium hydroxide, magnesium hydroxide, aluminum hydroxide, calcium methasilicate, calcium sulfate, barium sulfate, bentonite, silica, alumina, etc. Specific examples of the organic dispersants include polyvinyl alcohol, gelatin, methyl cellulose, methyl hydroxypropyl cellulose, ethyl cellulose, sodium salts of carboxylmethyl cellulose, starch, etc.

In addition, known nonionic, anionic and cationic surfactants, which may be marketed, can also be used as dispersants. Specific examples thereof include sodium dodecyl sulfate, sodium tetradecyl sulfate, sodium pentadecyl sulfate, sodium octyl sulfate, sodium oleate, sodium laurate, potassium stearate, calcium oleate, etc.

Inorganic dispersants, which are hardly soluble in water and which are soluble in acids, are preferably used for the suspension polymerization methods. The added amount of such an inorganic dispersant is from 0.2 to 2.0 parts by weight per 100 parts by weight of the vinyl monomers to be polymerized. The added amount of water used as the aqueous dispersing medium is from 300 to 3,000 parts by weight per 100 parts by weight of the vinyl monomers to be polymerized.

When an aqueous dispersing medium is prepared using an inorganic dispersant, which is hardly soluble in water, commercially available dispersants can be used. However, it is preferable to prepare a dispersant, which is hardly soluble in water and which consists of small particles having a sharp particle diameter distribution, in an aqueous dispersing medium such as water while agitating the dispersing medium at a high speed. For example, in the case of tricalcium phosphate, the method is as follows. At first, an aqueous solution of sodium phosphate and an aqueous solution of calcium chloride are mixed while agitating the mixture at a high speed. In this case, fine particles of tricalcium phosphate are formed therein. The thus prepared dispersion can be preferably used as the dispersant.

When preparing the toner of the present invention using a suspension polymerization method, a polymerizable monomer composition including at least a polymerizable monomer and toner constituents such as colorants is dispersed in an aqueous dispersing medium and subjected to suspension polymerization. In this regard, it is preferable that the toner constituents are well dispersed in the polymerizable monomer. In order to well disperse the toner constituents in the polymerizable monomer, it is preferable to apply a proper shearing force to the polymerizable monomer composition in the dispersing process. Therefore, the polymerizable monomer composition preferably has a proper viscosity (i.e., a relatively high viscosity). In order that the polymerizable monomer composition has a proper viscosity, a method in which a resin is previously dissolved in the polymerizable monomer composition or a method in which the polymerizable monomer is previously polymerized partially can be used.

When shearing energy is applied to the polymerizable monomer composition in the dispersing process, part of the energy is changed to heat energy. Therefore, the dispersion operation is performed while cooling the dispersion if necessary. If the amount of generated heat is large and cooling is not fully performed, the temperature of the polymerizable monomer composition increases, resulting in decrease of the viscosity of the polymerizable monomer composition. In this case, the shearing force is not fully applied to the polymerizable monomer composition, resulting in uneven dispersion of the toner constituents in the polymerizable monomer.

When the shearing force applied to the polymerizable monomer composition is too high, excessive dispersion of the toner constituents is made. In this case, the toner constituents are unstably dispersed, resulting in coagulation of the dispersoid (i.e., toner constituents), and thereby a problem in that the properties (such as tinting power) of the toner deteriorate is caused. Therefore, excessive dispersion of the toner constituents is not preferable.

The dispersing machine for use in dispersing the polymerizable monomer composition is not particularly limited. However, it is preferable to use a dispersing machine such as pressure dispersing machines (e.g., ultrasonic dispersing machines, mechanical homogenizers, MANTON GOLIN homogenizer, CLEAR MIX, and CLEAR SS5), and dispersing machines using a medium (e.g., attritors, sand grinders, GETZMAN MILL, and DIAMOND FINE MILL).

Next, the partial polymerization method in which a resin component is subjected to a polymer chain growth reaction and/or crosslinking reaction in a liquid will be explained.

In this method, an oil phase liquid including at least a colorant and a polyester prepolymer (X) having an isocyanate group is subjected to an extension reaction (polymer chain growth reaction) and/or a crosslinking reaction in an aqueous medium including a surfactant to produce toner particles including a urea-modified polyester (Z) and the colorant. In this regard, the oil phase liquid (i.e., the toner particles) preferably includes an unmodified polyester resin (Y), which preferably has an acid value of not less than 15 mgKOH/g. Low molecular weight polyamines and polyols are preferably used as polymer chain growing agents and crosslinking agents.

Until now, polymerization toners have been used for developing electrostatic latent images because high quality images having good fixing property can be produced. Among these polymerization toners, toner prepared by an ester extension polymerization method has advantages such that a polyester resin can be used as the binder resin and a crosslinked structure is incorporated in the binder resin, thereby imparting good fixing property to the toner. In addition, in order to further enhance the fixing property of the toner, the following technique can be used in the ester extension polymerization method. Specifically, it is preferable to incorporate a soft crosslinked skeleton into the binder resin and to use an unmodified polyester resin having a proper polarity. In addition, it is preferable that while a polyamine or a polyol serving as a polymer chain growing agent or a crosslinking agent is not used or a small amount of polyamine or polyol is used, some of the isocyanate groups present at the end of prepolymer (X) are converted to an amine, and the amine is then reacted with the residual isocyanate groups. By using this method, the number of urea bonds included in the resultant polymer can be reduced to half compared to the case where a predetermined amount of polyamine or polyol is used.

The unmodified polyester resin used for the ester extension polymerization method preferably has a proper polarity and a relatively low molecular weight, and hardly includes a crosslinked structure. It is preferable that the unmodified polyester resin melts in the fixing process and penetrates into receiving materials such as papers, resulting in anchoring of toner images at receiving materials. Therefore, it is preferable that the unmodified polyester resin has good affinity for receiving materials, namely, it is preferable that the resin has a proper acid value.

In the ester extension polymerization method, at first an isocyanate modified polyester resin (i.e., a polyester prepolymer), an unmodified polyester resin having no isocyanate group, an amine compound, and other toner constituents such as colorants, release agents, charge controlling agents, and viscosity controlling agents, are dissolved or dispersed in an organic solvent to prepare an oil phase liquid. The oil phase liquid is mixed with an aqueous medium including a dispersant such as low molecular weight surfactants and polymer dispersants (e.g., particulate organic resins), and the mixture is agitated to prepare an emulsion in which particles of the oil phase liquid are dispersed in the aqueous phase liquid. The isocyanate groups of the prepolymer in the oil phase liquid particles are reacted to the amine compound, resulting in formation of urea bond (i.e., occurrence of an extension reaction (a polymer chain growth reaction) and/or a crosslinking reaction). Thus, toner particles are prepared.

As mentioned above, since the unmodified polyester resin preferably penetrates into receiving materials in the fixing process, the polyester resin preferably has a relatively low molecular weight.

Next, methods for measuring the properties of toner will be explained.

1. Viscosity Analysis Using GPC-RALLS-Viscometer (1) Pretreatment

A sample (0.1 g of a toner or 0.05 g of a binder resin) is mixed with 10 ml of tetrahydrofuran (THF) in a test tube. The mixture is allowed to settle for 24 hours at 25° C. to dissolve the sample in THF. The solution is then filtered using a filter with a pore size of from 0.2 to 0.5 μm (such as MAISHORIDISK H-25-2 from Tosoh Corp.). Thus, a sample solution for GPC (gel permeation chromatography) is prepared.

(2) GPC Analysis

The GPC analysis is performed under the following conditions:

Instrument: HLC-8220GPC from Tosoh Corp.
TriSEC302DTA from Viscotek
Column: KF-800D+KF-805L(x2)
Temperature: 40° C.
Flow rate: 1.0 ml/min
Amount of injected sample: 400 μl In this analysis, the molecular weight distribution on the basis of absolute molecular weight, the inertia square radius and intrinsic viscosity of the sample (toner or binder resin) are directly output. The measurements are performed on the basis of the following theory.

[Measurement Theory]

$$M90=R(\theta 90)/KC \qquad \text{Reyleigh's equation}$$

M90: Molecular weight at 90°
R(θ90): Rayleigh ratio at a scattering angle of 90°
K: Optical constant ($=2\pi^2n^2/\lambda_0{}^4N_A\cdot(dn/dc)^2$)
C: Concentration of solution $$Rg=(1/6)^{1/2}([\eta]M90/\Phi)^{1/3} \qquad \text{Flory Fox's equation}$$

Rg: inertia radius
η: Intrinsic viscosity
Φ: Shape factor $$M=R(\theta 0)/KC$$

M: Absolute molecular weight
$R(\theta 0)=R(\theta 90)/P(\theta 90)$
$P(\theta 90)=2/X^2\cdot(e^{-X}-(1-X))(X=4\pi n/\lambda\cdot Rg)$
λ: Wavelength In this regard, the value (dn/dc) is 0.089 ml/g for a hybrid resin-containing toner, 0.078 ml/g for a toner including only a polyester resin or a resin in which polyester units are chemically connected, and 0.185 ml/g for a linear polystyrene.

The method for determining the inertia square radius Rs(Mp) will be explained.

Using seven TSK standard polystyrenes, A-2500, A-5000, F-1, F-2, F-4, F-10 and F-40 (from Tosoh Corp.), a working curve showing the relationship between the peak top molecular weight (Mp) and the inertia square radius is prepared.

Using this working curve, the inertia square radius (Rs(Mp)) of styrene can be determined as a square radius at a peak top molecular weight, which is the same as the peak top molecular weight (Mp) of the toner (or binder resin).

2. Viscoelasticity Measuring Method

In the present application, the storage modulus G' of a toner can be determined using a general dynamic viscoelasticity measuring method.

In the present application, a rheometer having a rotating plate, RHEOPLUS from Anton Paa Co., is used as an instrument. A pellet (disk) of the sample (such as toner), which has a diameter of 1.0 mm and a thickness of 2.5±0.3 mm, is prepared using a pelletizing machine. In this regard, a pressure of 30 MPa is applied for 30 seconds.

The sample is set on a parallel plate. The temperature is set to 100° C., and the measuring position is set to a position (thickness of the sample+0.1 mm). The sample is heated until the normal force gradually decreases. After the normal force becomes constant, the temperature is increased to 140° C. Next, the measuring position is set to the thickness of the sample. After the disk is faired, the disk is cooled to the measurement starting temperature (i.e., 50° C.) to perform the measurement.

The storage modulus G'(150) at 150° C. of the sample is determined under the following measurement conditions.

Frequency: 1 Hz

Initial strain: 0.1%

Temperature range: 50 to 220° C.

Temperature rising speed: 2° C./sec

3. Particle Diameter of Toner

In the present application, the volume average particle diameter (Dv) of a toner is determined by an instrument such as COULTER COUNTER TA-II, MULTISIZER II, and MULTISIZER III, all of which are manufactured by Beckman Coulter, Inc. The measurement method is as follows:

(1) a surfactant serving as a dispersant, preferably 0.1 to 5 ml of a 1% aqueous solution of an alkylbenzenesulfonic acid salt, is added to 100 to 150 ml of an electrolyte such as 1% aqueous solution of first class NaCl or ISOTON-II manufactured by Beckman Coulter, Inc.;

(2) 2 to 20 mg of a sample (i.e., a toner) to be measured is added into the mixture;

(3) the mixture is subjected to an ultrasonic dispersion treatment for about 1 to 3 minutes; and (4) the volume average particle diameter distribution and number average particle diameter distribution of the toner are measured using the instrument mentioned above and an aperture of 100 μm.

The volume average particle diameter and number average particle diameter of the toner can be determined from the thus obtained volume and number average particle diameter distributions.

In this case, the particle diameter channels are following 13 channels:

2.00 μm≦C1<2.52 μm; 2.52 μm≦C2<3.17 μm; 3.17 μm≦C3<4.00 μm;

4.00 μm≦C4<5.04 μm; 5.04 μm≦C5<6.35 μm; 6.35 μm≦C6<8.00 μm;

8.00 μm≦C7<10.08 μm; 10.08 μm≦C8<12.70 μm; 12.70 μm≦C9<16.00 μm;

16.00 μm≦C10<20.20 μm; 20.20 μm≦C11<25.40 μm; 25.40 μm≦C12<32.00 μm; and 32.00 μm≦C13<40.30 μm.

Thus, particles having a particle diameter not less than 2.00 μm and less than 40.30 μm are targeted.

Next, the image forming method and apparatus of the present invention will be explained.

The image forming apparatus of the present invention includes at least an image bearing member configured to bear an electrostatic latent image thereon; a charging device configured to uniformly charge a surface of the image bearing member; a light irradiating device configured to irradiate the charged image bearing member with light according to image data to form an electrostatic latent image thereon; a developing device configured to develop the electrostatic latent image with a developer including the toner mentioned above to form a toner image on the image bearing member; a transferring device configured to transfer the toner image onto a receiving material; and a fixing device configured to fix the toner image on the receiving material.

The image forming apparatus optionally includes other devices such as a discharging device configured to reduce charges remaining on the image bearing member; a cleaning device configured to clean the surface of the image bearing member after transferring the toner image; a toner recycling device configured to return the toner collected by the cleaning device to the developing device; and a controller configured to control the devices mentioned above.

The image forming method of the present invention includes a charging process of charging a surface of the image bearing member; a light irradiating process of irradiating the charged image bearing member with light according to image data to form an electrostatic latent image thereon; a developing process of developing the electrostatic latent image with a developer including the toner mentioned above to form a toner image on the image bearing member; a transferring process of transferring the toner image onto a receiving material; and a fixing process of fixing the toner image on the receiving material. The image forming method includes at least an electrostatic latent image forming process of forming an electrostatic latent image on the image bearing member (such as combinations of the charging process and the light irradiating process); the developing process; the transferring process; and the fixing process.

The image forming method optionally includes other processes such as a discharging process of reducing charges remaining on the image bearing member; a cleaning process of cleaning the surface of the image bearing member after transferring the toner image; a toner recycling process of returning the toner collected by the cleaning device to the developing device; and a controlling process of controlling the processes mentioned above.

An electrostatic latent image can be formed, for example, by uniformly charging a surface of the image bearing member using a charging device, and then irradiating the charged image bearing member with imagewise light.

A toner image can be formed, for example, by the following method. Specifically, a toner layer (or a developer layer including the toner) is formed on a developing roller serving as a developer bearing member. The toner layer is fed so as to be contacted with a photoreceptor serving as the image bearing member, thereby developing an electrostatic latent image on the photoreceptor with the toner, resulting in formation of a toner image on the photoreceptor. The toner (or developer) is agitated by an agitator in the developing device, and fed to a developer supplying member. The developer supplying member feeds the toner to the developer bearing member, and thereby the toner is accumulated on the developer bearing member. The toner (developer) on the developer bearing member then passes a gap between a developer layer thickness controlling member and the surface of the developer bearing member, resulting in formation of a developer layer on the developer bearing member, wherein the developer of the developer layer has been charged by the developer layer thickness controlling member.

An electrostatic latent image on the image bearing member (such as photoreceptors) is contacted with the developer layer including the charged toner at the developing region, resulting in formation of a toner image on the image bearing member.

The toner image transfer is performed, for example, by a transferring device which charges the toner image on the image bearing member with a transfer charger so that the toner image is easily transferred to a receiving material.

The toner image fixation is performed, for example, by a fixing device. When plural color images are transferred onto one receiving material sheet to form a multiple color image, the fixing operation is performed after each color image is transferred or after all the plural color images are transferred on a receiving material sheet.

The fixing device is not particularly limited, and a proper fixing device is used depending on the applications of the image forming apparatus. However, it is preferable to use a fixing device including a heating/pressing member configured to heat a toner image on the receiving material. Specific examples of the heating/pressing member include combinations of a heat roller and a pressure roller; combinations of a heat roller, a pressure roller and an endless belt; etc. The temperature of the heating/pressing member is generally from 80 to 200° C.

Next, an example (printer) of the image forming apparatus of the present invention will be explained by reference to drawings.

FIG. 1 illustrates an example (electrophotographic printer) of the image forming apparatus of the present invention.

The printer illustrated in FIG. 1 is a tandem type full color printer, which produces a full color image using yellow (Y), cyan (C), magenta (M) and black (K) color toners and in which plural image bearing members are arranged side by side in a direction such that an intermediate transfer belt 10 moves.

At first, the configuration of the printer will be explained. The printer has an image forming section 30 including four image forming units 2Y, 2C, 2M and 2K including respective photoreceptors 1Y, 1C, 1M and 1K, each of which serves as an image bearing member. Although each of the photoreceptors has a drum form, belt form photoreceptors or photoreceptors having other forms can also be used. Each of the photoreceptors 1 is rotated in a direction indicated by an arrow while contacting with the intermediate transfer belt 10. Each of the photoreceptors has configuration such that a photosensitive layer is located on a relatively thin cylindrical electroconductive substrate, and a protective layer is formed on the photosensitive layer optionally with an intermediate layer therebetween.

Figure 2:
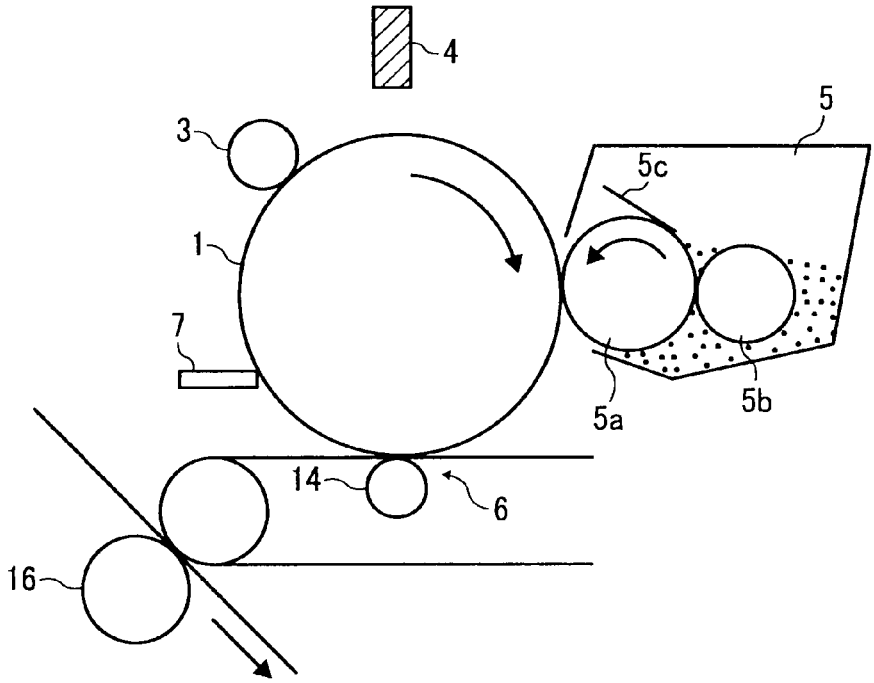
FIG. 2 illustrates an image forming section for use in the image forming apparatus of the present invention.

FIG. 2 illustrates an example of the image forming unit 2. Since four image forming units 2 have almost the same configuration, one of them is illustrated in FIG. 2 while the suffixes Y, C, M and K are sometimes deleted from the reference numbers.

Referring to FIG. 2, a charging device 3 configured to charge the photoreceptor 1, a developing device 5 configured to develop an electrostatic latent image on the photoreceptor 1 to form a toner image on the photoreceptor, a transfer device 6 configured to transfer the toner image onto the intermediate transfer medium 10 (or a receiving material), and a cleaning device 7 configured to remove toner particles remaining on the surface of the photoreceptor 1 after transferring the toner image, are arranged around the photoreceptor 1 in the rotation direction of the photoreceptor indicated by an arrow. There is a space between the charging device 3 and the developing device 5, so that a light irradiating device 4 can irradiate the photoreceptor 1 with a light beam according to image data through the space to form an electrostatic latent image on the surface of the photoreceptor.

The charging device 3 charges the photoreceptor 1 so that the photoreceptor has a negative charge. In this example, the charging device 3 is a contact or short-range charger having a charging roller. Specifically, in the charging device 3, a charging roller is contacted with the photoreceptor 1 or is set so as to be close to the photoreceptor and a negative DC bias is applied to the charging roller, so that the photoreceptor 1 has a surface potential of −500V.

Instead of a DC bias, a DC voltage on which an AC voltage is superimposed can also be used as the charge bias. In addition, the charging device 3 can include a cleaning brush configured to clean the surface of the charging roller. Further, a thin film may be wound on each end portion of the charging roller, and the wound film portions of the charging roller are contacted with the surface of the photoreceptor 1 so that the charging roller serves as a short-range charging roller. In this case, discharging occurs in the gap between the surface of the charging roller and the surface of the photoreceptor 1, resulting in charging of the photoreceptor.

The thus charged photoreceptor 1 is exposed to a light beam, which is emitted by the light irradiating device 4 and which includes one of image data of Y, C, M and K color images, resulting in formation of an electrostatic latent image corresponding to the color image. Specific examples of the light irradiating device include devices using laser, combinations of a LED array and a focusing device, etc.

The electrostatic latent images thus formed on the photoreceptors 1Y, 1C, 1M and 1K are developed with the respective developing devices 5.

Referring to FIG. 1, color toners in toner bottles 31Y, 31C, 31M and 31K are supplied to the respective developing devices. Referring to FIG. 2, the toner thus supplied is fed by a developer supplying roller 5*b*, and thereby the toner is born on the surface of a developing roller 5*a*. Since the developing roller 5*a* is rotated in a direction indicated by an arrow, the toner is fed to a development region, in which the developing roller faces the photoreceptor 1. In the development region, the developing roller 5*a* and the photoreceptor 1 move in the same direction and the developing roller moves at a faster linear speed than the photoreceptor. Therefore, the toner on the surface of the developing roller 5*a* rubs the surface of the photoreceptor 1 and is supplied to the photoreceptor. In this regard, a development bias of −300V is applied to the developing roller 5*a* by a power source (not shown), resulting in formation of a development electric field in the development region. Thereby, an electrostatic force is formed between the developing roller 5*a* and an electrostatic latent image on the photoreceptor 1 in a direction such that the toner on the developing roller moves toward the electrostatic latent image, resulting in adhesion of the toner to the electrostatic latent image, thereby forming a color toner image on the photoreceptor. Thus, four color toner images are formed on the respective photoreceptors 1Y, 1C, 1M and 1K.

The color toner images thus formed on four the photoreceptors 1 are then transferred one by one onto the intermediate transfer medium 10 of the transfer device 6, which is an endless belt. The intermediate transfer medium 10 is rotated by three support rollers 11, 12 and 13 (illustrated in FIG. 1) in a direction indicated by an arrow while tightly stretched by the rollers. The color toner images are transferred one by one by an electrostatic transfer method so as to be overlaid on the intermediate transfer medium 10. Although a transfer charger can be used for the electrostatic transfer method, a transfer roller 14 is preferably used therefor because occurrence of a toner scattering problem in that when a toner image is transferred, the toner image is seriously scattered can be prevented. Specifically, primary transfer rollers 14Y, 14C, 14M and 14K of the transfer device 6 are arranged so as to be contacted with the respective photoreceptors 1 with the intermediate transfer medium 10 therebetween, resulting in formation of four primary transfer nips.

A positive bias is applied to each primary transfer roller 14, and thereby a transfer electric field is formed on each primary transfer nip. Therefore, the toner image on each photoreceptor 1 can be electrostatically transferred onto the intermediate transfer medium 10.

A belt cleaning device 15 (illustrated in FIG. 1) is provided in the vicinity of the intermediate transfer medium 10 to remove toner particles remaining on the transfer medium using a fur brush or a cleaning blade. The toner particles collected by the belt clearing device 15 are fed to a waste toner tank (not shown) by a feeding device (not shown).

Referring to FIG. 1, the support roller 13 is contacted with a secondary transfer roller 16 with the intermediate transfer medium 10 therebetween to form a secondary transfer nip. A sheet of a receiving material is timely fed to the secondary transfer nip. The receiving material sheets are contained in a cassette 20 located under the light irradiating device 4, and are timely fed to the secondary transfer nip one by one by a feeding roller 21, and a pair of registration rollers 22. The color toner images overlaid on the intermediate transfer medium 10 (i.e., a combined color toner image) are transferred onto a receiving material sheet at the secondary transfer nip. A positive bias is applied to the secondary transfer roller 16, resulting in formation of an electric field, thereby transferring the toner images onto the receiving material sheet.

The combined toner image on the receiving material sheet is then fixed with a heat fixing device 23 located on the downstream side from the secondary transfer nip relative to the receiving material sheet feeding direction. The heat fixing device 23 includes a heat roller 23*a* and a pressure roller 23*b*. The receiving material sheet passing the secondary transfer nip is fed to the nip between the rollers 23*a* and 23*b*, at which heat and pressure are applied to the color toner image, thereby fusing the toner image, resulting in fixation of the toner image on the receiving material sheet. The receiving material sheet bearing the fixed toner image thereon is then discharged by a discharging roller 24 to a tray located on the top of the printer.

In the developing device 5, the developing roller 5*a* is partially projected from the opening of the casing as illustrated in FIG. 2. In this example of the image forming apparatus, a one component developer including the toner of the present invention and no carrier is used as the developer. The developing devices 5Y, 5C, 5M and 5K receive the respective color toners from the toner bottles 31Y, 31C, 31M and 31K and contain the respective toners therein. The toner bottles are detachably attached to the printer, and each of the toner bottles can be independently replaced with a new bottle. Specifically, when one of the toner bottles empties, only the toner bottle is replaced with a new bottle. Therefore, running costs can be reduced.

Figure 3:
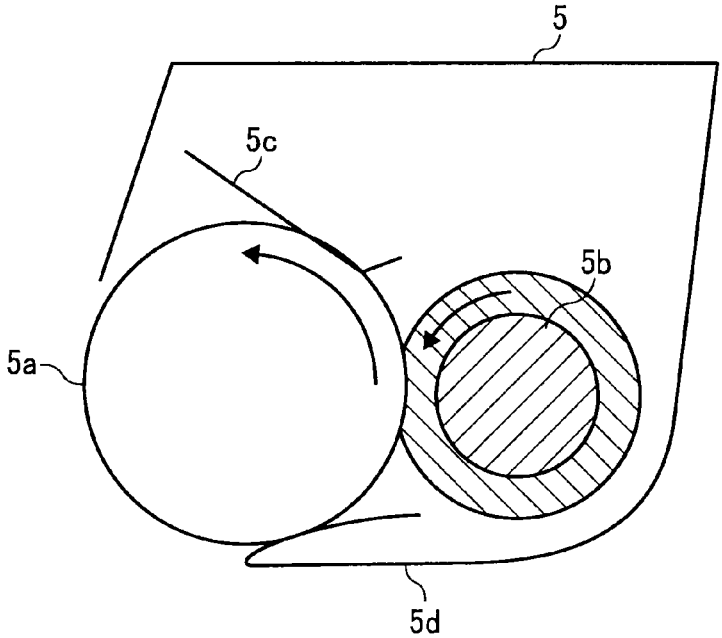
FIG. 3 illustrates the developing device of the image forming section illustrated in FIG. 2.

FIG. 3 is an enlarged view of the developing device 5 illustrated in FIG. 2. The developer (in this case, the toner of the present invention) in a developer containing portion (i.e., a portion surrounded by a casing 5*d*) of the developing device 5 is fed to the developing roller 5*a* (i.e., the nip between the developing roller 5*a* and developer supplying roller 5*b*) by the developer supplying roller 5*b* while agitated. In this regard, the developing roller 5*a* and developer supplying roller 5*b* move in the opposite directions at the nip therebetween. In addition, the toner fed to the developing roller 5*a* is layered by a developer layer thickness controlling blade 5*c*, which is set so as to be contacted with the surface of the developing roller 5*a*. Thus, the toner is rubbed at the nip between the rollers 5*a* and 5*b* and at the nip between the roller 5*a* and the blade 5*c*, and thereby the toner is charged to have a proper amount of charge.

Next, the process cartridge of the present invention will be explained.

Figure 4:
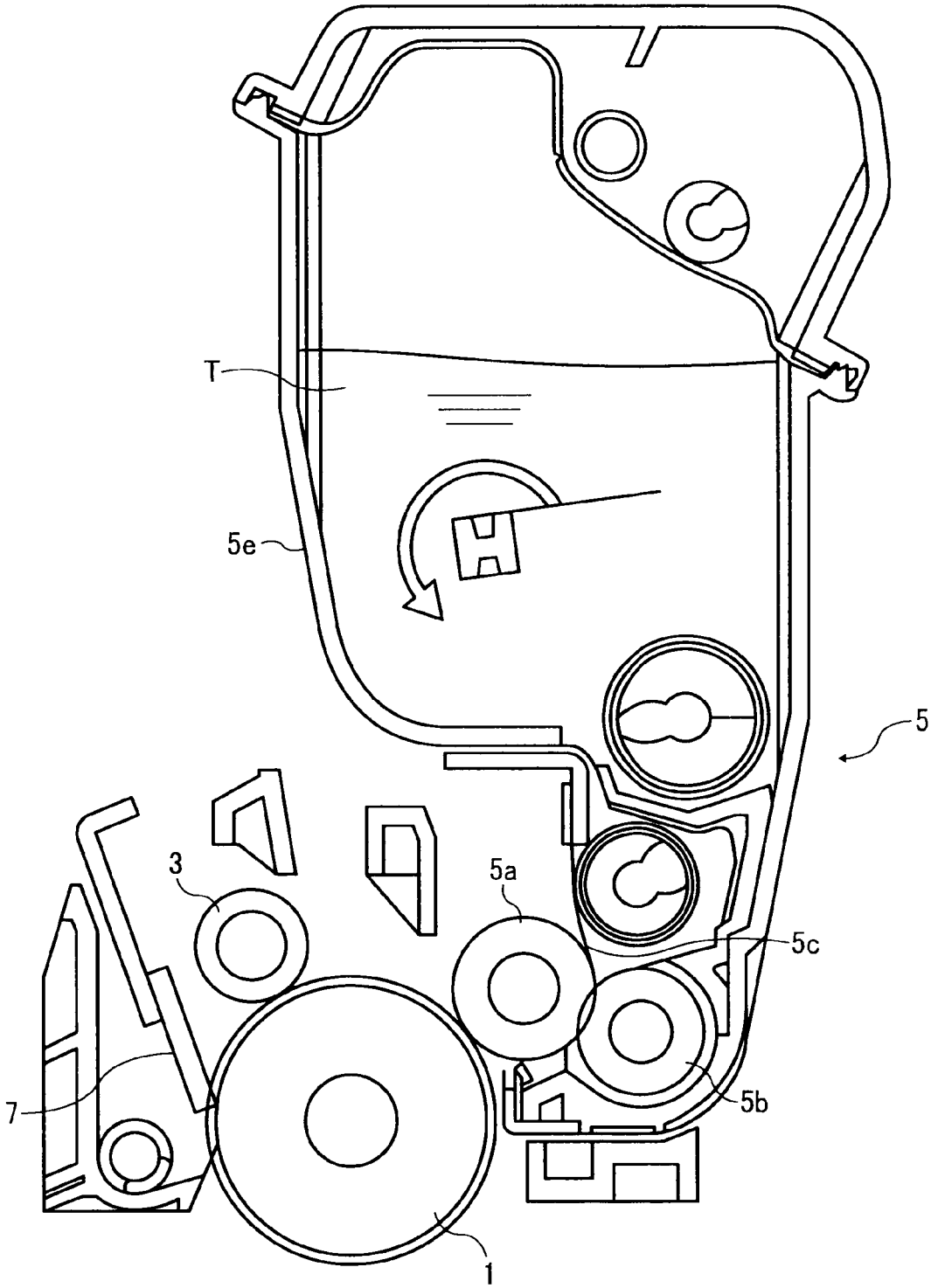
FIG. 4 illustrates an example of the process cartridge for use in the image forming apparatus of the present invention.

FIG. 4 illustrates an example of the process cartridge of the present invention.

The toner of the present invention can be preferably used for an image forming apparatus equipped with the process cartridge. The process cartridge of the present invention includes at least an image bearing member (such as photoreceptors) and a developing device configured to develop an electrostatic latent image on the image bearing member with a developer including the toner of the present invention, which are integrated as a unit. The process cartridge optionally includes other devices such as charging devices, cleaning devices and discharging devices, if desired. The process cartridge is detachably attached to an image forming apparatus such as copiers and printers. The example of the process cartridge illustrated in FIG. 4 includes the photoreceptor 1, a charging roller serving as the charging device 3, the developing device 5, and a cleaning blade serving as the cleaning device 7. The developing device 5 includes the developing roller 5*a*, developer supplying roller 5*b* and developer layer thickness controlling blade 5*c*. In FIG. 4, numeral 5*e* denotes a developer containing portion configured to contain a developer including the toner of the present invention, and character T denotes the toner of the present invention. The developing device includes at least the developing roller 5*a* and the developer containing portion 5*e*, and optionally includes the developer supplying roller 5*b* and developer layer forming blade 5*c*.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

[Preparation of Polyesters 1 and 2]

The following components were fed into a reaction vessel equipped with a condenser, an agitator and a nitrogen feed pipe.

| | |
|---|---|
| Propylene oxide (2 mole) adduct of bisphenol A | 725 parts |
| Terephthalic acid | 305 parts |
| Dibutyltin oxide | 2 parts |

The mixture was subjected to a polymerization reaction for 7 hours at 230° C. under normal pressure, followed by a further polymerization reaction for 5 hours under a reduced pressure of from 10 to 15 mmHg (1.33 to 2.00 Pa). Thus a polyester 1 was prepared. Five hundred (500) parts of the polyester 1 was dissolved in 750 parts of ethyl acetate to prepare an ethyl acetate solution of the polyester 1 (hereinafter referred to as a solution 1).

Next, 25,000 parts of methanol was fed into a container equipped with an agitator. The solution 1 was gradually fed into the container while agitating the mixture. In this regard, methanol-insoluble components in the polyester 1 were precipitated in the mixture. After the solution 1 was added, agitation was stopped so that the white precipitate sinks to the bottom of the container. After the precipitate was separated from the supernatant liquid, the precipitate was gradually heated from 30 to 70° C. under a reduced pressure of from 10 to 15 mmHg (1.33 to 2.00 Pa) to remove the residual solvent therefrom. Thus, a polyester 2 was prepared.

[Preparation of Polyesters 3 and 4]

The following components were fed into a reaction vessel equipped with a condenser, an agitator and a nitrogen feed pipe.

| | |
|---|---|
| Propylene oxide (2 mole) adduct of bisphenol A | 715 parts |
| Terephthalic acid | 310 parts |
| Dibutyltin oxide | 2 parts |

The mixture was subjected to a polymerization reaction for 4 hours at 230° C. under normal pressure, followed by a further polymerization reaction for 6 hours under a reduced pressure of from 10 to 15 mmHg (1.33 to 2.00 Pa). Thus a polyester 3 was prepared. Five hundred (500) parts of the polyester 3 was dissolved in 750 parts of ethyl acetate to prepare an ethyl acetate solution of the polyester 3 (hereinafter referred to as a solution 3).

Next, 25,000 parts of methanol was fed into a container equipped with an agitator. The solution 3 was gradually fed into the container while agitating the mixture. In this regard, methanol-insoluble components in the polyester 3 were precipitated in the mixture. After the solution 3 was added, agitation was stopped so that the white precipitate sinks to the bottom of the container. After the precipitate was separated from the supernatant liquid, the precipitate was gradually heated from 30 to 70° C. under a reduced pressure of from 10 to 15 mmHg (1.33 to 2.00 Pa) to remove the residual solvent therefrom. Thus, a polyester 4 was prepared.

[Preparation of Polyesters 5 and 6]

The following components were fed into a reaction vessel equipped with a condenser, an agitator and a nitrogen feed pipe.

| | |
|---|---|
| Ethylene oxide (2 mole) adduct of bisphenol A | 255 parts |
| Propylene oxide (2 mole) adduct of bisphenol A | 445 parts |
| Terephthalic acid | 60 parts |
| Isophthalic acid | 215 parts |
| Dibutyltin oxide | 2 parts |

The mixture was subjected to a polymerization reaction for 7 hours at 230° C. under normal pressure, followed by a further polymerization reaction for 6 hours under a reduced pressure of from 10 to 18 mmHg (1.33 to 2.40 Pa). Next, 24 parts by weight of trimellitic anhydride was added to the reaction product, and the mixture was subjected to a polymerization reaction for 2 hours at 180° C. under normal pressure. Thus a polyester 5 was prepared. Five hundred (500) parts of the polyester 5 was dissolved in 800 parts of ethyl acetate to prepare an ethyl acetate solution of the polyester 5 (hereinafter referred to as a solution 5).

Next, 26,000 parts of methanol was fed into a container equipped with an agitator. The solution 5 was gradually fed into the container while agitating the mixture. In this regard, methanol-insoluble components in the polyester 5 were precipitated in the mixture. After the solution 5 was added, agitation was stopped so that the white precipitate sinks to the bottom of the container. After the precipitate was separated from the supernatant liquid, the precipitate was gradually heated from 30 to 70° C. under a reduced pressure of from 10 to 15 mmHg (1.33 to 2.0 Pa) to remove the residual solvent therefrom. Thus, a polyester 6 was prepared.

[Preparation of Polyester 7]

The following components were fed into a reaction vessel equipped with a condenser, an agitator and a nitrogen feed pipe.

| | |
|---|---|
| Propylene oxide (2 mole) adduct of bisphenol A | 718 parts |
| Terephthalic acid | 310 parts |
| Dibutyltin oxide | 2 parts |

The mixture was subjected to a polymerization reaction for 9 hours at 230° C. under normal pressure, followed by a further polymerization reaction for 5 hours under a reduced pressure of from 10 to 15 mmHg (1.33 to 2.00 Pa). Five hundred (500) parts of the thus prepared polyester was dissolved in 800 parts of ethyl acetate to prepare an ethyl acetate solution of the polyester.

Next, 26,000 parts of methanol was fed into a container equipped with an agitator. The solution of the polyester was gradually fed into the container while agitating the mixture. In this regard, methanol-insoluble components in the polyester were precipitated in the mixture. After the solution was added, agitation was stopped so that the white precipitate sinks to the bottom of the container. After the precipitate was separated from the supernatant liquid, the precipitate was gradually heated from 30 to 70° C. under a reduced pressure of from 10 to 15 mmHg (1.33 to 2.00 Pa) to remove the residual solvent therefrom. Thus, a polyester 7 was prepared.

[Preparation of Polyester 8]

The following components were fed into a reaction vessel equipped with a condenser, an agitator and a nitrogen feed pipe.

| | |
|---|---|
| Propylene oxide (2 mole) adduct of bisphenol A | 711 parts |
| Terephthalic acid | 317 parts |
| Dibutyltin oxide | 2 parts |

The mixture was subjected to a polymerization reaction for 10 hours at 230° C. under normal pressure, followed by a further polymerization reaction for 5 hours under a reduced pressure of from 10 to 15 mmHg (1.33 to 2.00 Pa). Five hundred (500) parts of the thus prepared polyester was dissolved in 800 parts of ethyl acetate to prepare an ethyl acetate solution of the polyester.

Next, 26,000 parts of methanol was fed into a container equipped with an agitator. The solution of the polyester was gradually fed into the container while agitating the mixture. In this regard, methanol-insoluble components in the polyester were precipitated in the mixture. After the solution was added, agitation was stopped so that the white precipitate sinks to the bottom of the container. After the precipitate was separated from the supernatant liquid, the precipitate was gradually heated from 30 to 70° C. under a reduced pressure of from 10 to 15 mmHg (1.33 to 2.00 Pa) to remove the residual solvent therefrom. Thus, a polyester 8 was prepared.

[Preparation of Polyesters 9 and 10]

The following components were fed into a reaction vessel equipped with a condenser, an agitator and a nitrogen feed pipe.

| | |
|---|---|
| Ethylene oxide (2 mole) adduct of bisphenol A | 218 parts |
| Propylene oxide (2 mole) adduct of bisphenol A | 460 parts |
| Terephthalic acid | 140 parts |
| Isophthalic acid | 145 parts |
| Dibutyltin oxide | 2 parts |

The mixture was subjected to a polymerization reaction for 8 hours at 230° C. under normal pressure, followed by a further polymerization reaction for 6 hours under a reduced pressure of from 10 to 18 mmHg (1.33 to 2.40 Pa). Next, 24 parts by weight of trimellitic anhydride was added to the reaction product, and the mixture was subjected to a polymerization reaction for 2 hours at 180° C. under normal pressure. Thus a polyester 9 was prepared. Four hundred and fifty (450) parts of the polyester 9 was dissolved in 900 parts of ethyl acetate to prepare an ethyl acetate solution of the polyester 9 (hereinafter referred to as a solution 9).

Next, 26,000 parts of methanol was fed into a container equipped with an agitator. The solution 9 was gradually fed into the container while agitating the mixture. In this regard, methanol-insoluble components in the polyester 9 were precipitated in the mixture. After the solution 9 was added, agitation was stopped so that the white precipitate sinks to the bottom of the container. After the precipitate was separated from the supernatant liquid, the precipitate was gradually heated from 30 to 70° C. under a reduced pressure of from 10 to 15 mmHg (1.33 to 2.0 Pa) to remove the residual solvent therefrom. Thus, a polyester 10 was prepared.

[Preparation of Polyester 11]

The following components were fed into a reaction vessel equipped with a condenser, an agitator and a nitrogen feed pipe.

| | |
|---|---|
| Ethylene oxide (2 mole) adduct of bisphenol A | 156 parts |
| Propylene oxide (2 mole) adduct of bisphenol A | 505 parts |
| Terephthalic acid | 80 parts |
| Trimellitic anhydride | 129 parts |
| Dodecenylsuccinic anhydride | 130 parts |
| Dibutyltin oxide | 2 parts |

The mixture was subjected to a polymerization reaction for 10 hours at 210° C. under normal pressure, followed by a further polymerization reaction for 6 hours under a reduced pressure of from 10 to 18 mmHg (1.33 to 2.40 Pa). Thus, a polyester 111 was prepared.

[Preparation of Prepolymer]

The following components were fed into a reaction vessel equipped with a condenser, an agitator and a nitrogen feed pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyltin oxide | 2 parts |

The mixture was subjected to a polymerization reaction for 8 hours at 230° C. under normal pressure, followed by a further polymerization reaction for 5 hours under a reduced pressure of from 10 to 15 mmHg (1.33 to 2.00 Pa). Thus, an intermediate polyester 1 was prepared.

Next, the following components were fed into a reaction vessel equipped with a condenser, an agitator and a nitrogen feed pipe.

| | |
|---|---|
| Intermediate polyester 1 | 411 parts |
| Isophorone diisocyanate | 89 parts |
| Ethyl acetate | 500 parts |

The mixture was subjected to a reaction for 5 hours at 100° C. Thus, a prepolymer 1 was prepared.

Example 1

[Preparation of Toner 1]

[Preparation of Master Batch 1]

The following components were mixed using a HENSCHEL MIXER mixer.

| | |
|---|---|
| C.I. Pigment Blue 15:3 | 40 parts |
| Polyester 10 | 60 parts |
| Water | 30 parts |

Thus, a mixture in which water penetrates into aggregates of the pigment was prepared. The mixture was kneaded for 45 minutes using a two-roll mill in which the rollers are heated to 130° C. The kneaded mixture was pulverized so that the resultant particles have a particle size of 1 mm. Thus, a master batch 1 was prepared.

[Preparation of Pigment/Wax Dispersion (Oil Phase Liquid)]

The following components were fed into a container equipped with an agitator and a thermometer.

| | |
|---|---|
| Polyester 2 | 530 parts |
| Paraffin wax (having a thermal property such that the endothermic peak is present at 73.1° C. and the half width of the peak is 3.9° C. when the wax is subjected to differential scanning calorimetry (DSC)) | 86 parts |
| Ethyl acetate | 1100 parts |

The mixture was heated to 80° C. while agitated. The mixture was further agitated for 5 hours at 80° C. The mixture was then cooled to 30° C. over 1 hour.

The following components were mixed for 1 hour in a container.

| | |
|---|---|
| Master batch 1 | 332 parts |
| Ethyl acetate | 100 parts |

Thus, a toner constituent mixture liquid 1 was prepared.

Next, 1800 parts of the toner constituent mixture liquid 1 was subjected to a dispersing treatment using a bead mill (ULTRAVISCOMILL from AIMEX CO., Ltd.) under the following conditions.

Liquid feeding speed: 1 kg/hr

Peripheral speed of disk: 6 m/sec

Bead: zirconia bead with a diameter of 0.5 mm

Filling factor of bead: 80% by volume

Repeat number of dispersing operation: 3 times (3 passes)

Thus, a dispersion was prepared.

Next, the following components were added to the dispersion.

| | |
|---|---|
| 60% ethyl acetate solution of polyester 10 | 500 parts |
| 70% ethyl acetate solution of polyester 2 | 700 parts |
| Ethyl acetate | 100 parts |

The mixture was further subjected to a dispersing treatment using a bead mill (ULTRAVISCOMILL from AIMEX CO., Ltd.) under the following conditions.

Liquid feeding speed: 1 kg/hr

Peripheral speed of disk: 6 m/sec

Bead: zirconia bead with a diameter of 0.5 mm

Filling factor of bead: 80% by volume

Repeat number of dispersing operation: 1 time (1 pass)

Thus, a pigment/wax dispersion 1 (oil phase liquid) was prepared. The pigment/wax dispersion 1 was diluted with ethyl acetate so that the dispersion has a solid content of 50% when the solid content is determined by heating the dispersion for 30 minutes at 130° C.

[Preparation of Aqueous Phase Liquid]

The following components were mixed

| | |
|---|---|
| Ion-exchange water | 970 parts |
| 25% aqueous dispersion of Particulate resin (Resin: copolymer of styrene-methacrylic acid-butyl acrylate-sodium salt of sulfate of ethylene oxide adduct of methacrylic acid) | 40 parts |
| 48.5% aqueous solution of sodium salt of dodecyldiphenyletherdisulfonic acid | 140 parts |
| Ethyl acetate | 90 parts |

Thus, an aqueous phase liquid 1 was prepared.

[Preparation of Emulsion]

The following components were mixed for 1 minute using a TK HOMOMIXER mixer from Tokushu Kika Kogyo Co., Ltd., in which the rotor was rotated at a revolution of 5,000 rpm.

| | |
|---|---|
| Pigment/wax dispersion 1 | 975 parts |
| Isophorone diamine | 2.1 parts |

The mixture was mixed with 80 parts of the prepolymer 1, and the mixture was agitated for 1 minute using the TK HOMOMIXER mixer, in which the rotor was rotated at a revolution of 5,000 rpm. Further, 1,200 parts of the aqueous phase liquid was added thereto, and the mixture was agitated for 20 minutes using the TK HOMOMIXER mixer, in which revolution of the rotor was controlled so as to be from 8,000 to 13,000 rpm.

Thus, an emulsion 1 was prepared.

[Washing and Drying]

After 100 parts of the emulsion 1 was filtered under a reduced pressure, the following operations (1) to (4) were performed.

(1) The wet cake was mixed with 100 parts of ion-exchange water and the mixture was agitated for 10 minutes using a TK HOMOMIXER mixer rotated at a revolution of 12,000 rpm, followed by filtering.

(2) The thus prepared wet cake was mixed with 100 parts of a 10% aqueous solution of sodium hydroxide, and the mixture was agitated for 30 minutes using a TK HOMOMIXER mixer rotated at a revolution of 12,000 rpm while ultrasonically vibrating the mixture, followed by filtering under a reduced pressure. This ultrasonic alkali washing operation was performed twice.

(3) The wet cake prepared above in the operation (2) was mixed with 100 parts of a 10% aqueous solution of hydrochloric acid, and the mixture was agitated for 10 minutes using a TK HOMOMIXER mixer rotated at a revolution of 12,000 rpm, followed by filtering.

(4) The wet cake prepared above in the operation (3) was mixed with 300 parts of ion-exchange water, and the mixture was agitated for 10 minutes using a TK HOMOMIXER mixer rotated at a revolution of 12,000 rpm, followed by filtering. This washing operation was performed twice.

Thus, a final wet cake (hereinafter referred to as a wet cake 1) was prepared.

The wet cake 1 was dried for 48 hours in a circulating dryer heated to 45° C., followed by sieving with a screen having openings of 75 μm. Thus a mother toner (toner particles) 1 was prepared. It was confirmed that the mother toner 1 has a volume average particle diameter (Dv) of 5.8 μm and a number average particle diameter (Dp) of 5.1 μm.

The following components were mixed using a HENSCHEL MIXER mixer.

| | |
|---|---|
| Mother toner 1 | 100 parts |
| Hydrophobized silica | 0.5 parts |
| Hydrophobized titanium oxide | 0.5 parts |

Thus, a toner of Example 1 was prepared.

When the toner was subjected to the above-mentioned GPC-RALLS viscosity analysis, it was found that the toner has the following properties.

Content of components (W3000) having molecular weight of not greater than 3,000: 16% by weight Peak top molecular weight (Mp): 6,400

Inertia square radius Rt(Mp) at Mp: 3.45

Rt(Mp)/Rs(Mp): 1.14

G'(150) at 1 Hz and 150° C.: $1.19\times10^4$

Example 2

The procedure for preparation and evaluation of the toner in Example 1 was repeated except that the polyester 2 was replaced with the polyester 7.

Thus, a toner of Example 2 was prepared.

Example 3

The procedure for preparation and evaluation of the toner in Example 1 was repeated except that the polyester 2 was replaced with the polyester 4.

Thus, a toner of Example 3 was prepared.

Example 4

The procedure for preparation and evaluation of the toner in Example 1 was repeated except that the polyester 10 was replaced with the polyester 9.

Thus, a toner of Example 4 was prepared.

Example 5

The following components were mixed using a HENSCHEL MIXER mixer.

| | |
|---|---|
| Polyester 2 | 45 parts |
| Polyester 10 | 15 parts |
| Polyester 11 | 40 parts |
| Polyethylene wax (melting point of 120° C.) | 4 parts |
| C.I. Pigment Blue 15:3 | 5 parts |
| 3,5-di-tert-butylsalicylic acid zinc salt | 2 parts |

The mixture was kneaded using a double axis extruder while controlling the conditions of the extruder such that the temperature of the kneaded mixture is 130° C. at the exit of the extruder. After the kneaded mixture was cooled, the kneaded mixture was pulverized and classified to prepare a mother toner 5 having a volume average particle diameter of 7±0.5 μm.

The following components were mixed using a HENSCHEL MIXER mixer.

| | |
|---|---|
| Mother toner 5 | 100 parts |
| Hydrophobized silica | 0.5 parts |
| Hydrophobized titanium oxide | 0.5 parts |

Thus, a toner of Example 5 was prepared.

Comparative Example 1

The procedure for preparation and evaluation of the toner in Example 1 was repeated except that the polyester 2 was replaced with the polyester 1.

Thus, a toner of Comparative Example 1 was prepared.

Comparative Example 2

The procedure for preparation and evaluation of the toner in Example 1 was repeated except that the polyester 2 was replaced with the polyester 5.

Thus, a toner of Comparative Example 2 was prepared.

Comparative Example 3

The procedure for preparation and evaluation of the toner in Example 1 was repeated except that the polyester 2 was replaced with the polyester 6.

Thus, a toner of Comparative Example 3 was prepared.

Comparative Example 4

The procedure for preparation and evaluation of the toner in Example 1 was repeated except that the polyester 2 was replaced with the polyester 3.

Thus, a toner of Comparative Example 4 was prepared.

Comparative Example 5

The procedure for preparation and evaluation of the toner in Example 1 was repeated except that the polyester 2 was replaced with the polyester 8.

Thus, a toner of Comparative Example 5 was prepared.

Comparative Example 6

The procedure for preparation and evaluation of the toner in Example 5 was repeated except that the polyester 2 was replaced with the polyester 1.

Thus, a toner of Comparative Example 6 was prepared.

The toners prepared above were evaluated as follows.

1. High Temperature Preservability (HTP)

The high temperature preservability of each toner was evaluated using the method for measuring penetration based on JIS K2235-1991, which is as follows.

(1) At first, 20 g of a sample (toner) is contained in a 20 ml glass container;

(2) the container is allowed to settle for 24 hours in a chamber heated to 55° C.;

(3) the toner in the container is cooled to 24° C.; and (4) the toner is subjected to a penetration test in which a needle is penetrated into the toner layer at a predetermined pressure and the length (L) of the part of the needle penetrated into the toner layer is measured.

In this regard, the longer penetration length (L) a toner has, the better high temperature preservability the toner has. The high temperature preservability is graded as follows:

◎: The penetration length (L) is not shorter than 20 mm. (Excellent)

○: The penetration length (L) is shorter than 20 mm and not shorter than 15 mm.

Δ: The penetration length (L) is shorter than 15 mm and not shorter than 10 mm.

x: The penetration length (L) is shorter than 10 mm. (Bad)

2. Low Temperature Fixability (Lowest Fixing Temperature) (LTF)

Each toner is set in an image forming apparatus illustrated in FIG. 1, IPSIO SP C220, from which the fixing unit is removed and which is modified such that the system speed of the apparatus can be easily changed, and 19 unfixed toner images of an original image having a solid image of a square with 40 mm×40 mm are produced, wherein the solid image has a weight of 9 g/m$^2$. Next, the unfixed toner images are fixed using the fixing unit, which is removed from the image forming apparatus and which is modified such that the temperature of the fixing roller (i.e., fixing temperature) can be changed and the fixing speed is 300 mm/sec. In this regard, the fixing temperature was changed from 120 to 200° C. at regular intervals of 5° C.

Each of the fixed toner images is subjected to a scratch test using a drawing tester AD-401 from Ueshima Seisakusho Co., Ltd. The procedure of the scratch test is as follows.

The surface of a fixed solid image is scanned with a sapphire needle having a tip with a curvature of 125 μm at a pressure of 1 g to draw a circle with a diameter of 8 mm, and the scratched portion is visually observed to determine whether the scratched portion is observed as a white spot, i.e., to determine the lowest fixing temperature. The lowest fixing temperature of the toner is defined as the minimum fixing temperature, above which the scratched portion of the fixed image is not observed as a white spot.

The low temperature fixability of the toners is graded as follows:

◎: The lowest fixable temperature is not higher than 130° C. (Excellent)

○: The lowest fixable temperature is from 135° C. to 140° C.

Δ: The lowest fixable temperature is from 145° C. to 150° C.

x: The lowest fixable temperature is not lower than 155° C. (Bad)

3. High Temperature Fixability (Hot Offset Resistance) (HTF)

The glossiness of the fixed toner images prepared above in the paragraph 2 (low temperature fixability) is measured using a gloss meter from Nippon Denshoku Industries Co., Ltd., wherein the incident angle of light is set to 60°. In addition, a graph showing the relationship between the fixing temperature and the glossiness of the fixed toner image is prepared. The hot offset temperature is defined as a fixing temperature from which the glossiness decreases as the fixing temperature increases.

The high temperature fixability of the toners is graded as follows:

◎: The hot offset temperature is higher than 200° C. (Excellent)

○: The hot offset temperature is from 195° C. to 200° C.

Δ: The hot offset temperature is from 180° C. to 190° C.

x: The hot offset temperature is not higher than 175° C. (Bad)

4. Fixability (Glossiness) (GL)

The glossiness of the fixed toner image, which is fixed at 160° C., is graded as follows:

◎: The glossiness is not lower than 14% and less than 30%. (Excellent)

○: The glossiness is not lower than 6% and less than 14%.

Δ: The glossiness is not lower than 3% and less than 6%.

x: The glossiness is lower than 3%. (Bad)

5. Development Durability (1) Background Fouling (BF)

At first, 150 g of each toner is contained in the toner bottle 31C (illustrated in FIG. 1), and a running test in which 5,000 copies of a white solid image are continuously produced is performed. The 5,000$^{th}$ image is visually observed to determine whether the white image is soiled with the toner (i.e., whether the image has background fouling).

The background fouling is graded as follows.

◎: The image has no background fouling. (Excellent)

○: The image has slight background fouling when the image is observed at an angle.

Δ: The image has background fouling when the image is observed at an angle.

x: The image has clear background fouling. (Bad)

(2) Toner Fixation on the Photoreceptor (R-F Image)

After the running test, the surface of the photoreceptor is observed to determine whether the toner is fixed to the surface of the photoreceptor (i.e., whether a fixed toner having a rice-fish form is observed).

The toner fixation property (R-F image) is graded as follows.

◎: The photoreceptor has no fixed toner. (Excellent)

○: The photoreceptor has very small fixed toner.

Δ: The photoreceptor has small fixed toner with a size of less than 1 mm.

x: The photoreceptor has relatively large fixed toner with a size of not less than 1 mm. (Bad)

(3) Toner Fixation on the Developer Layer Thickness Controlling Blade (FIX)

In addition, a developer thickness controlling blade is removed from the developing device of the image forming apparatus, and air is supplied to the tip portion of the blade using an air gun to remove the toner particles, which are loosely adhered to the blade, from the blade and to determined whether the toner is fixed to the tip of the blade.

The toner fixation property (toner fixation on developer layer thickness controlling blade) is graded as follows.

◎: The blade has no fixed toner. (Excellent)

○: The blade has a small amount of fixed toner thereon, but the fixed toner can be easily peeled therefrom by lightly rubbed with a finger.

Δ: The blade has a small amount of fixed toner thereon, and the fixed toner cannot be easily peeled therefrom by lightly rubbed with a finger.

x: The blade has clear fixed toner thereon. (Bad)

The formulations of the toners are shown in Table 1, and the evaluation results are shown in Tables 2 and 3.

TABLE 1

| | Binder resin | | | Percentage of resins | | |
|---|---|---|---|---|---|---|
| Toner | First resin | Second resin | Third resin (or precursor thereof) | First resin | Second resin | Third resin (or precursor thereof) |
| Ex. 1 | PE 2 | PE 10 | PP 1 | 60 | 30 | 10 |
| Ex. 2 | PE 7 | PE 10 | PP 1 | 60 | 30 | 10 |
| Ex. 3 | PE 4 | PE 10 | PP 1 | 60 | 30 | 10 |
| Ex. 4 | PE 2 | PE 9 | PP 1 | 60 | 30 | 10 |
| Ex. 5 | PE 2 | PE 10 | PE 11 | 45 | 15 | 40 |
| Comp. Ex. 1 | PE 1 | PE 10 | PP 1 | 60 | 30 | 10 |
| Comp. Ex. 2 | PE 5 | PE 10 | PP 1 | 60 | 30 | 10 |
| Comp. Ex. 3 | PE 6 | PE 10 | PP 1 | 60 | 30 | 10 |
| Comp. Ex. 4 | PE 3 | PE 10 | PP 1 | 60 | 30 | 10 |
| Comp. Ex. 5 | PE 8 | PE 10 | PP 1 | 60 | 30 | 10 |
| Comp. Ex. 6 | PE 1 | PE 10 | PE 11 | 45 | 15 | 40 |

PE: Polyester
PP: Prepolymer

TABLE 2

| | Properties of toner | | | | |
|---|---|---|---|---|---|
| Toner | W (3000) | Mp | Rt (Mp) | Rt (Mp)/ Rs (Mp) | G' (150) dN/m$^2$ |
| Ex. 1 | 16 | 6400 | 3.45 | 1.14 | $1.19 \times 10^4$ |
| Ex. 2 | 13 | 9100 | 3.98 | 1.08 | $1.43 \times 10^4$ |
| Ex. 3 | 19 | 4700 | 3.12 | 1.22 | $8.92 \times 10^3$ |
| Ex. 4 | 19 | 6500 | 3.46 | 1.13 | $1.16 \times 10^4$ |
| Ex. 5 | 18 | 8500 | 3.61 | 1.02 | $1.00 \times 10^4$ |
| Comp. Ex. 1 | 27 | 6200 | 3.27 | 1.10 | $1.11 \times 10^4$ |
| Comp. Ex. 2 | 22 | 9400 | 2.12 | 0.57 | $1.28 \times 10^4$ |

TABLE 2-continued

| Toner | Properties of toner | | | | |
|---|---|---|---|---|---|
| | W (3000) | Mp | Rt (Mp) | Rt (Mp)/ Rs (Mp) | G' (150) $dN/m^2$ |
| Comp. Ex. 3 | 17 | 9700 | 2.15 | 0.57 | $1.31 \times 10^4$ |
| Comp. Ex. 4 | 30 | 3800 | 2.90 | 1.27 | $7.77 \times 10^3$ |
| Comp. Ex. 5 | 11 | 10900 | 4.15 | 1.03 | $1.55 \times 10^4$ |
| Comp. Ex. 6 | 28 | 8400 | 3.59 | 1.02 | $9.87 \times 10^3$ |

TABLE 3

| Toner | | Fixability | | | Development durability | | |
|---|---|---|---|---|---|---|---|
| | HTP | LTF | GL | HTF | FIX | R-F image | BF |
| Ex. 1 | ◎ | ○ | ◎ | ◎ | ◎ | ◎ | ◎ |
| Ex. 2 | ◎ | ○ | ○ | ◎ | ◎ | ◎ | ◎ |
| Ex. 3 | Δ | ◎ | ◎ | ◎ | Δ | ◎ | ○ |
| Ex. 4 | ○ | ○ | ◎ | ◎ | ○ | ◎ | ◎ |
| Ex. 5 | ○ | ◎ | ○ | ○ | ○ | ○ | ◎ |
| Comp. Ex. 1 | X | ◎ | ○ | ○ | X | X | —* |
| Comp. Ex. 2 | X | ◎ | ○ | ○ | X | X | —* |
| Comp. Ex. 3 | ○ | Δ | ○ | ○ | X | Δ | Δ |
| Comp. Ex. 4 | X | ◎ | ○ | X | X | X | —* |
| Comp. Ex. 5 | ◎ | X | X | ◎ | ◎ | ◎ | ◎ |
| Comp. Ex. 6 | X | ◎ | ◎ | X | X | X | —* |

HTP: High temperature preservability
LTF: Low temperature fixability
GL: Glossiness
HTF: High temperature fixability
FIX: Toner fixation on the developer thickness controlling blade
R-F image: Toner fixation on the photoreceptor
BF: Background fouling
—*: Since the image has a number of white streak images (i.e., portions with no background fouling) due to toner fixation on the developer thickness controlling blade, the degree of the background fouling cannot be evaluated.

It is clear from Tables 1-3 that the toner of the present invention has a good combination of high temperature preservability and stress resistance, and can produce glossy images while having good fixability (wide fixable range) even when high speed fixation is performed.

According to the present invention, a combination of a low molecular weight resin having rigidity and linearity and a high molecular weight resin is used for the toner. Therefore, the effects of the present invention can be effectively produced. In addition, since the low molecular weight resin and the high molecular weight resin can be uniformly mixed, the effects of the present invention can be more effectively produced. Further, since the high molecular weight resin has wide flexibility in designing the branched and crosslinked structure thereof, the effects can be more effectively produced.

Furthermore, by using a method, in which the high molecular weight resin (which is hardly soluble in a solvent) is prepared in the process of preparing the toner, the high molecular weight resin can be easily included in the toner without dissolving the resin in a solvent, and thereby the effects can be effectively produced. Furthermore, by incorporating a vinyl resin unit in the binder resin, a wax can be easily dispersed in the toner, and thereby exuding of the wax from toner particles can be prevented, resulting in improvement of the preservation stability and stress resistance of the toner.

This document claims priority and contains subject matter related to Japanese Patent Application No. 2008-238467, filed on Sep. 17, 2008, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin; and a colorant, and satisfying the following relationships (1)-(3):

$$W(3000) \leqq 20\% \text{ by weight} \quad (1);$$

$$4000 \leqq Mp \leqq 10000 \quad (2); \text{ and}$$

$$Rt(Mp)/Rs(Mp) > 0.98 \quad (3),$$

wherein

W(3000) represents a percentage of components having a molecular weight of not higher than 3000 in tetrahydrofuran-soluble components of the toner determined by subjecting the tetrahydrofuran-soluble components to a GPC-RALLS viscosity analysis, Mp represents a molecular weight at a peak top of a main peak in a molecular weight distribution curve of the tetrahydrofuran-soluble components obtained by the GPC-RALLS viscosity analysis, Rt(Mp) represents an inertia square radius at the molecular weight Mp, and Rs(Mp) represents an inertia square radius of linear polystyrene at the molecular weight Mp, wherein the inertia square radius Rs(Mp) is determined from a working curve obtained by subjecting plural polystyrenes having different molecular weights to the GPC-RALLS viscosity analysis.

2. The toner of claim 1, having a storage modulus (G'150) of from $2.0 \times 10^3$ to $1.4 \times 10^4$ $dN/m^2$ at 150° C.

3. The toner of claim 1, wherein the binder resin comprises resin (A); and resin (B), wherein the resin (A) is a polyester resin having no branched or crosslinked structure, and wherein the resin (B) is a resin comprising a polyester unit having a branched or crosslinked structure.

4. The toner of claim 3, wherein the toner is prepared by a method comprising:

(i) dissolving or dispersing toner constituents comprising the resin (A), the resin (B) or a precursor of the resin (B), and the colorant, in an organic solvent to prepare a toner constituent mixture liquid; and (ii) dispersing the toner constituent mixture liquid in an aqueous medium.

5. The toner of claim 4, wherein the toner constituents comprise the resin (A), the precursor of the resin (B), and the colorant, and wherein the precursor is a polyester precursor comprising an isocyanate group, and the method further includes:

subjecting the isocyanate group of the polyester precursor to a reaction to prepare the resin (B) comprising a polyester unit comprising a urea bond, a urethane bond, or a urea bond and a urethane bond.

6. The toner of claim 5, wherein the reaction is performed in the organic solvent.

7. The toner of claim 3, wherein the resin (B) is a hybrid resin having both of a polyester unit and a vinyl resin unit.

8. An image forming method, the method comprising:

forming an electrostatic latent image on an image bearing member;

developing the electrostatic latent image with a developer comprising the toner of claim 1 to prepare a toner image on the image bearing member;

transferring the toner image onto a receiving material; and fixing the toner image on the receiving material.

9. The toner of claim 1, satisfying $$W(3000)<18\% \text{ by weight} \quad (1).$$

10. The toner of claim 1, satisfying $$W(3000)\leqq 15\% \text{ by weight} \quad (1).$$

11. The toner of claim 1, satisfying $$4500\leqq Mp\leqq 9500 \quad (2).$$

12. The toner of claim 1, satisfying $$5000\leqq Mp\leqq 9000 \quad (2).$$

13. The toner of claim 5, wherein a content of the polyisocyanate unit in the polyester prepolymer (A) having an isocyanate group is from 0.5 to 40% by weight.

14. The toner of claim 5, wherein a content of the polyisocyanate unit in the polyester prepolymer (A) having an isocyanate group is from 1 to 30% by weight.

15. The toner of claim 5, wherein a content of the polyisocyanate unit in the polyester prepolymer (A) having an isocyanate group is from 2 to 20% by weight.

16. The toner of claim 5, wherein an average number of isocyanate groups comprised in a molecule of the isocyanate modified polyester is not less than 1.

17. The toner of claim 5, wherein an average number of isocyanate groups comprised in a molecule of the isocyanate modified polyester is from 1.5 to 3.

18. The toner of claim 5, wherein an average number of isocyanate groups comprised in a molecule of the isocyanate modified polyester is from 1.8 to 2.5.

19. The toner of claim 1, further comprising a wax in an amount of from 2 to 5% by weight, based on a total weight of the toner.

* * * * *